US010890062B2

(12) United States Patent
Rodney

(10) Patent No.: US 10,890,062 B2
(45) Date of Patent: Jan. 12, 2021

(54) INFERRING ORIENTATION PARAMETERS OF A STEERING SYSTEM FOR USE WITH A DRILL STRING

(71) Applicant: Halliburton Energy Services, Inc., Houston, TX (US)

(72) Inventor: Paul F. Rodney, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/466,563

(22) PCT Filed: Aug. 2, 2018

(86) PCT No.: PCT/US2018/045053

§ 371 (c)(1),
(2) Date: Jun. 4, 2019

(87) PCT Pub. No.: WO2020/027848

PCT Pub. Date: Feb. 6, 2020

(65) Prior Publication Data

US 2020/0270981 A1 Aug. 27, 2020

(51) Int. Cl.

| | |
|---|---|
| ***E21B 47/024*** | (2006.01) |
| ***E21B 44/00*** | (2006.01) |
| ***E21B 7/06*** | (2006.01) |

(52) U.S. Cl.

CPC ..... *E21B 47/024* (2013.01); *E21B 7/067* (2013.01); *E21B 44/00* (2013.01); *E21B 2200/20* (2020.05)

(58) Field of Classification Search

CPC ..... E21B 7/10; E21B 47/024; E21B 47/092; E21B 47/0228; E21B 2200/20

See application file for complete search history.

(56) References Cited

U.S. PATENT DOCUMENTS

| | | | |
|---|---|---|---|
| 4,649,349 | A | 3/1987 | Chiron et al. |
| 4,761,889 | A | 8/1988 | Cobern et al. |
| 4,901,804 | A | 2/1990 | Thometz et al. |
| 4,909,336 | A | 3/1990 | Brown et al. |
| RE33,708 | E | 10/1991 | Roesler |
| 5,155,916 | A | 10/1992 | Engebretson |
| 5,321,893 | A | 6/1994 | Engebretson |

(Continued)

FOREIGN PATENT DOCUMENTS

| | | |
|---|---|---|
| EP | 0857855 | 11/2002 |

OTHER PUBLICATIONS

ISRWO International Search Report and Written Opinion for PCT/US2018/045053 dated Apr. 30, 2019.

*Primary Examiner* — Cathleen R Hutchins

(74) *Attorney, Agent, or Firm* — Benjamin Ford; C. Tumey Law Group PLLC

(57) ABSTRACT

A method to steer a drill bit of a rotary steerable system within a wellbore can include introducing the rotary steerable system into the wellbore. The method can further include establishing a magnetic model associated with the drill bit. Magnetic field parameters are measured at various locations of the rotary steerable system. A magnetic gradient tensor of the magnetic field parameters can be determined. Orientation parameters are solved with respect to the magnetic model and based on the magnetic gradient tensor. The drill bit can be steered based on the calculated parameters.

20 Claims, 10 Drawing Sheets

(56) References Cited

U.S. PATENT DOCUMENTS

| | | | | |
|---|---|---|---|---|
| 5,803,176 | A * | 9/1998 | Blizzard, Jr. | E21B 7/061 166/117.6 |
| 5,806,194 | A | 9/1998 | Rodney et al. | |
| 6,076,268 | A | 6/2000 | Fuhr | |
| 6,633,816 | B2 | 10/2003 | Shirasaka et al. | |
| 8,095,317 | B2 | 1/2012 | Ekseth et al. | |
| 8,185,312 | B2 | 5/2012 | Ekseth et al. | |
| 8,428,879 | B2 | 4/2013 | Ekseth et al. | |
| 8,490,717 | B2 | 7/2013 | Bergstrom et al. | |
| 2002/0130663 | A1* | 9/2002 | Kuckes | E21B 47/024 324/326 |
| 2009/0078462 | A1 | 3/2009 | Boone et al. | |
| 2009/0084546 | A1 | 4/2009 | Ekseth et al. | |
| 2009/0309600 | A1* | 12/2009 | Seydoux | E21B 47/01 324/338 |
| 2010/0096186 | A1 | 4/2010 | Ekseth et al. | |
| 2012/0024606 | A1 | 2/2012 | Pirovolou et al. | |
| 2013/0151158 | A1 | 6/2013 | Brooks et al. | |
| 2016/0258280 | A1 | 9/2016 | Murphree et al. | |
| 2016/0362937 | A1* | 12/2016 | Dyer | E21B 44/00 |
| 2019/0169974 | A1* | 6/2019 | Melo Uribe | E21B 47/12 |
| 2019/0353023 | A1* | 11/2019 | Whitacre | G01V 3/38 |

* cited by examiner

INFERRING ORIENTATION PARAMETERS OF A STEERING SYSTEM FOR USE WITH A DRILL STRING

TECHNICAL FIELD

The present description relates in general to calculating orientation parameters of a steering system, and more particularly, for example and without limitation, to calculating orientation parameters of a steering system from magnetic parameters.

BACKGROUND OF THE DISCLOSURE

In the oil and gas industry, wellbores are commonly drilled to recover hydrocarbons such as oil and gas.

To reach desired subterranean formations, it is often required to undertake directional drilling, which entails dynamically controlling the direction of drilling, rather than simply drilling a nominally vertical wellbore path. Directionally drilled wellbores can include portions that are vertical, curved, horizontal, and portions that generally extend laterally at any angle from the vertical wellbore portions.

BRIEF DESCRIPTION OF THE DRAWINGS

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

Figure 2:
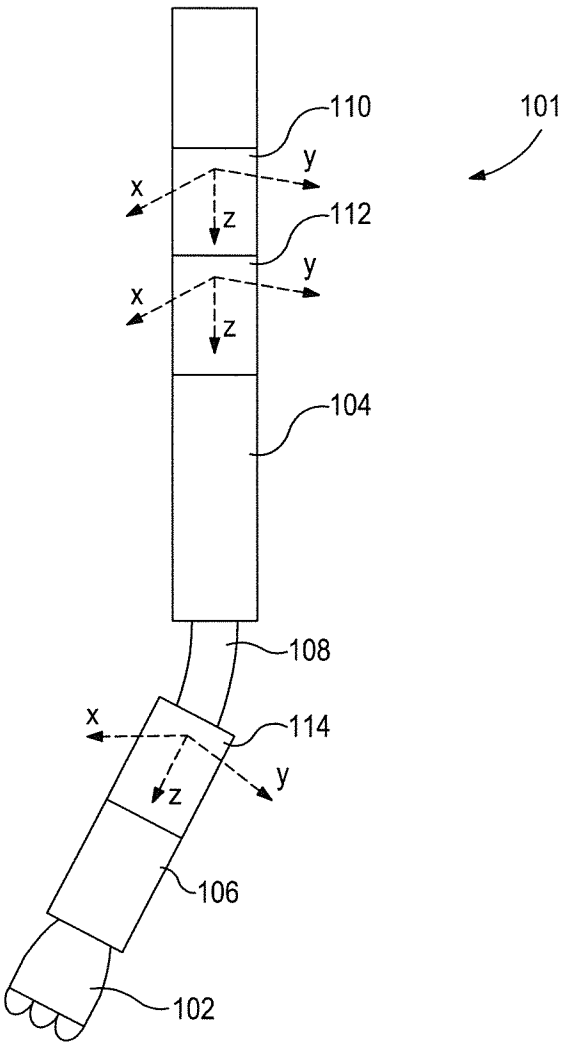
FIG. 2 is an elevation view of a rotary steerable system, according to one or more embodiments of the present disclosure.

This section provides various example implementations of the subject matter disclosed, which are not exhaustive. As those skilled in the art would realize, the described implementations may be modified without departing from the scope of the present disclosure. Accordingly, the drawings and description are to be regarded as illustrative in nature and not restrictive.

The present description relates in general to calculating orientation parameters of a steering system, and more particularly, for example and without limitation, to calculating orientation parameters of a steering system from magnetic parameters.

A directional drilling technique can involve the use of a rotary steerable drilling system that controls an azimuthal direction and/or degree of deflection while the entire drill string is rotated continuously. Rotary steerable drilling systems typically involve the use of an actuation mechanism that helps the drill bit deviate from the current path using either a "point the bit" or "push the bit" mechanism. In a "point the bit" system, the actuation mechanism deflects and orients the drill bit to a desired position by bending the drill bit drive shaft within the body of the rotary steerable assembly. As a result, the drill bit tilts and deviates with respect to the wellbore axis. In a "push the bit" system, the actuation mechanism is used to instead push against the wall of the wellbore, thereby offsetting the drill bit with respect to the wellbore axis. While drilling a straight section, the actuation mechanism remains disengaged so that there is generally no pushing against the formation, or optionally uniformly engaged, so there is no appreciable offset of the drill bit with respect to the wellbore axis. As a result, the drill string proceeds generally concentric to the wellbore axis. Yet another directional drilling technique, generally referred to as the "push to point," encompasses a combination of the "point the bit" and "push the bit" methods.

To control the operation of a rotary steerable system, orientation parameters of the rotary steerable system are obtained to guide and control the path of the drill bit. Orientation parameters of the rotary steerable device can include, but are not limited to, the bend or deflection angle of a flexible portion of the rotary steerable device, the tool-face angle of the rotary steerable device, the azimuth of the upper portion of the rotary steerable device, and the azimuth of the lower portion of the rotary steerable device and/or the drill bit. In one or more embodiments, deflection of flexible portions of the rotary steerable system can prevent sensors from being disposed directly thereto.

To obtain orientation parameters without the use of sensors on a flexible portion of the rotary steerable system, magnetic field parameters can be measured above and below a flexible portion of the rotary steerable system to infer the orientation parameters of the rotary steerable system. However, inferring orientation parameters from magnetic field parameters can be challenging, as considerable and unpredictable amounts of magnetic interference, including magnetic interference from the drill bit, may be present in a downhole environment. Further, inferring orientation parameters can be challenging when the azimuth of the rotary steerable tool is poorly defined, such as when the rotary steerable tool is in a nearly vertical orientation.

An aspect of at least one or more embodiments disclosed herein is that by inferring orientation parameters of the steering system, operation of the steering system can be optimized. A further aspect, according to at least one or more embodiments disclosed herein is that by measuring magnetic parameters, orientation parameters can be inferred without additional equipment. Yet another aspect, according to at least one or more embodiments disclosed herein is that by utilizing advanced solving techniques, accurate orientation parameters can be provided using magnetic field sensors despite magnetic interference.

Figure 1:
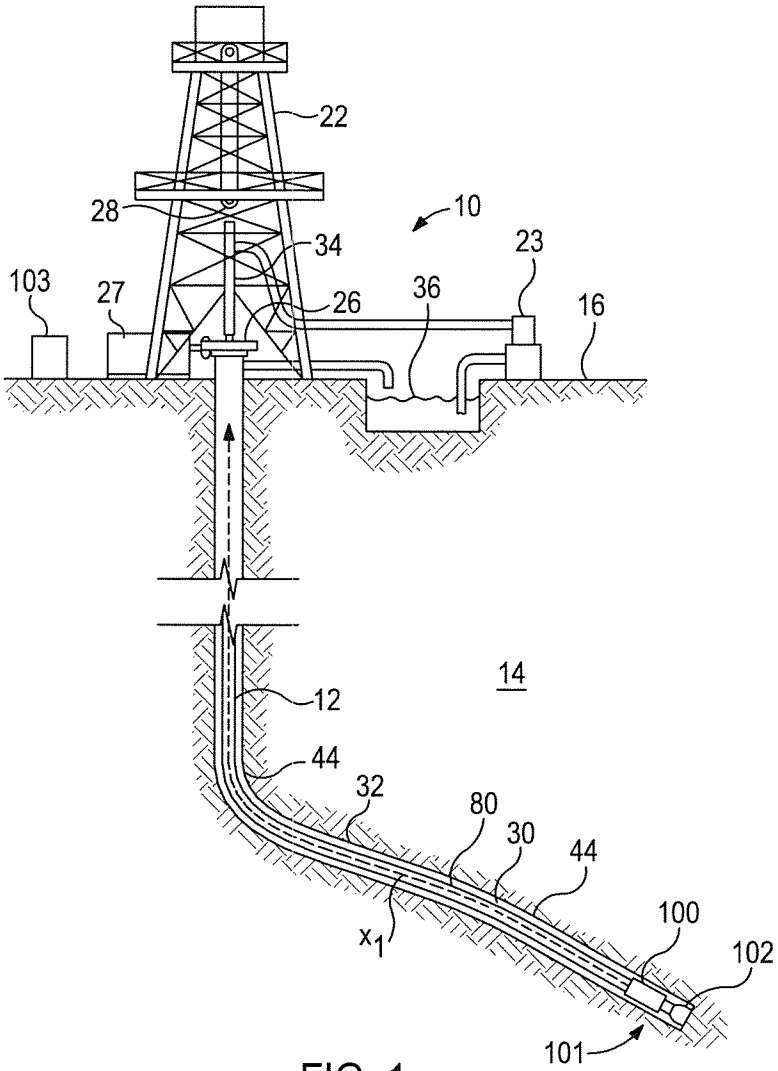
FIG. 1 illustrates a partial cross-sectional view of an onshore well system including a downhole tool illustrated as part of a tubing string, according to one or more embodiments of the present disclosure.

FIG. 1 illustrates a partial cross-sectional view of an onshore well system including a downhole tool illustrated as part of a tubing string, according to one or more embodiments of the present disclosure. FIG. 1 shows a representative elevation view in partial cross-section of an onshore well system 10 which can include a drilling rig (or derrick) 22 at the surface 16 used to extend a tubing string 30 into and through portions of a subterranean earthen formation 14. The tubing string 30 can carry a drill bit 102 at its end, which can be rotated to drill through the formation 14. A bottom hole assembly (BHA) 101 interconnected in the drill string or tubing string 30 proximate the drill bit 102 can include components and assemblies (not expressly illustrated in FIG. 1), such as, but not limited to, logging while drilling (LWD) equipment, measure while drilling (MWD) equipment, a bent sub or housing, a mud motor, a near bit reamer, stabilizers, steering assemblies, and other downhole instruments. The BHA 101 can also include a downhole tool 100 that can provide a rotary steerable system used for steering the wellbore 12 drilling of the drill bit 102. Steering of the drill bit 102 can be used to facilitate deviations 44 as shown in FIG. 1, and/or steering can be used to maintain a section in a wellbore 12 without deviations, since steering control can also be needed to prevent deviations in the wellbore 12.

In one or more embodiments, the well system 10 can include a controller 103 for controlling the operation of the downhole tool 100. The controller 103 can include a processor for processing, storing in a computer-readable storage medium for storing a program code executed by the processor, and displaying to a user operation parameters. Examples of a computer-readable storage medium include non-transitory medium such as random access memory (RAM) devices, read only memory (ROM) devices, optical devices (e.g., CDs or DVDs), and disk drives. The controller 103 is capable of receiving data from sensors and controlling the operation of the downhole tool 100. In one or more embodiments, the processor may be provided with a user interface for input and control.

At the surface location 16, the drilling rig 22 can be provided to facilitate drilling the wellbore 12. The drilling rig 22 can include a turntable 26 that rotates the tubing string 30 and the drill bit 102 together about the longitudinal axis X1. The turntable 26 can be selectively driven by an engine 27, and selectively locked to prohibit rotation of the tubing string 30. A hoisting device 28 and swivel 34 can be used to manipulate the tubing string 30 into and out of the wellbore 12. To rotate the drill bit 102 with the tubing string 30, the turntable 26 can rotate the tubing string 30, and mud can be circulated downhole by mud pump 23. The mud may be a calcium chloride brine mud, for example, which can be pumped through the tubing string 30 and passed through the downhole tool 100. In one or more embodiments, the downhole tool 100 can include an actuatable steering element. Additionally, the mud can be pumped through a mud motor (not expressly illustrated in FIG. 1) in the BHA 101 to turn the drill bit 102 without having to rotate the tubing string 30 via the turntable 26.

Although the downhole tool 100 is shown and described with respect to a rotary drill system in FIG. 1, those skilled in the art will readily appreciate that many types of drilling systems can be employed in carrying out embodiments of the disclosure. For example, drills and drill rigs used in embodiments of the disclosure may be used onshore (as depicted in FIG. 1) or offshore (not shown). Offshore oilrigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

While not specifically illustrated, those skilled in the art will readily appreciate that the BHA 101 may further include various other types of drilling tools or components such as, but not limited to, a steering unit, one or more stabilizers, one or more mechanics and dynamics tools, one or more drill collars, one or more accelerometers, one or more magnetometers, and one or more jars, and one or more heavy weight drill pipe segments.

Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as wellbore construction for river crossing tunneling and other such tunneling wellbores for near surface construction purposes or wellbore u-tube pipelines used for the transportation of fluids such as hydrocarbons.

FIG. 2 is an elevation view of a rotary steerable system, according to one or more embodiments of the present disclosure. In the depicted example, the downhole tool or rotary steerable system 100 can deflect the lower portion 106 to steer the drill bit 102 and control the direction of drilling. In one or more embodiments, the lower portion 106 includes a steering pad or other actuator to deflect or steer the lower portion 106 relative to the upper portion 104 of the rotary steerable system 100.

In the depicted example, a flexible collar 108 facilitates steering via bending or deflection of the rotary steerable system 100, and more particularly, a bend angle β between the lower portion 106 and the upper portion 104. In one or more embodiments, the flexible collar 106 can allow for bending while transmitting torque from a drill string coupled to the upper portion 104 to the lower portion 106 and the drill bit 102.

In the depicted example, orientation parameters of the lower portion 106 and the upper portion 104 of the rotary steerable system 100 can be utilized to control the direction of drilling of the rotary steerable system 100. In one or more embodiments, a model is established and utilized to infer the value of orientation parameters from measured and observed data.

In the depicted example, the rotary steerable system 100 can include a first survey instrument package 110, a second survey instrument package 112, and a third survey instrument package 114. In one or more embodiments, the first survey instrument package 110 and the second survey instrument package 112 are disposed within the upper portion 104, while the third survey instrument package 114 is disposed within the lower portion 106. The second survey instrument package 112 is axially offset from the first survey instrument package 110 and the third survey instrument package 114 is axially offset from the drill bit 102. In the depicted example, the third survey instrument package 114 moves with the drill bit 102 relative to the first and second survey instrument packages 110, 112 as the lower portion 106 deflects relative to the upper portion 104. Measurement parameters from the survey instrument packages 110, 112, 114 can be analyzed to determine desired orientation parameters of the drill bit 102.

In one or more embodiments, the first survey instrument package 110 can be referred to as an upper direction and inclination module. In the depicted example, the first survey instrument package 110 can include a magnetometer. The magnetometer can be an anisotropic magnetoresistive, triaxial magnetometer. In the depicted example, the first survey instrument package 110 can also include an accelerometer. Further, the accelerometer can be a triaxial micro electro mechanical system accelerometer. In the depicted example, the first survey instrument package 110 provides a respective coordinate system. In one or more embodiments, the first survey instrument package 110 can include sensors for additional measurements.

In one or more embodiments, the second survey instrument package 112 can be referred to as a directional module. In the depicted example, the second survey instrument package 112 can include a magnetometer. The magnetometer can be an anisotropic magnetoresistive, triaxial magnetometer. In the depicted example, the second survey instrument package 112 can also include an accelerometer. Further, the accelerometer can be a triaxial micro electro mechanical system accelerometer. In the depicted example, the second survey instrument package 112 provides a respective coordinate system. In one or more embodiments, the second survey instrument package 112 can include sensors for additional measurements.

In one or more embodiments, the third survey instrument package 114 can be referred to as an at bit inclination module. In the depicted example, the third survey instrument package 114 can include a magnetometer. The magnetometer can be an anisotropic magnetoresistive, triaxial magnetometer. In the depicted example, the third survey instrument package 114 can also include an accelerometer. Further, the accelerometer can be a triaxial micro electro mechanical system accelerometer. In the depicted example, the third survey instrument package 114 provides a respective coordinate system. In one or more embodiments, the third survey instrument package 114 can include sensors for additional measurements.

Figure 3:
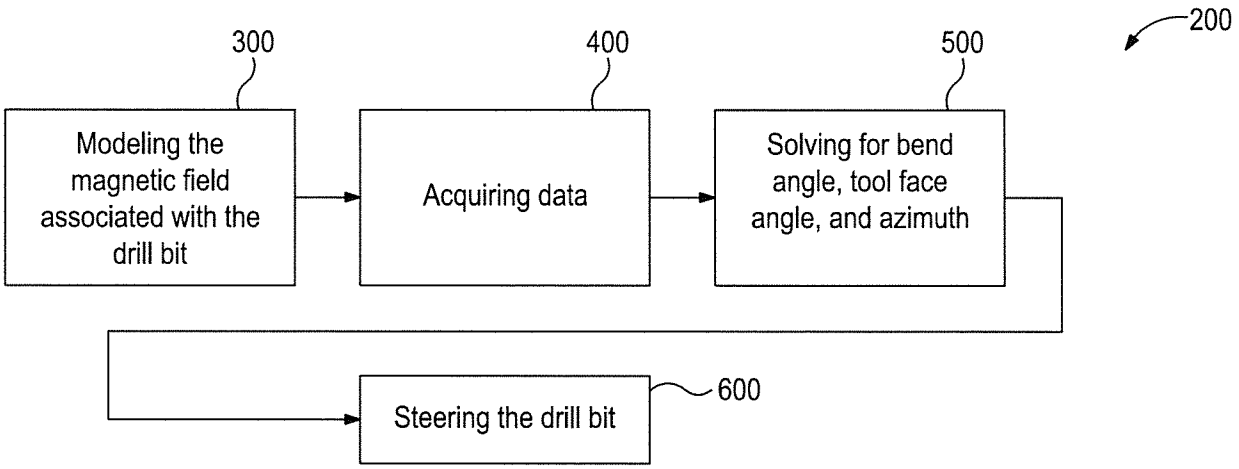
FIG. 3 illustrates a method to steer a drill bit, according to one or more embodiments of the present disclosure.

FIG. 3 illustrates a method to steer a drill bit, according to one or more embodiments of the present disclosure. In the depicted example, the method 200 can provide orientation parameters of a rotary steerable system modeled from measured data to allow control of a directional drilling operation.

In the depicted example, in step 300 of the method 200, a model is established to infer orientation parameters from observed and measured data. In one or more embodiments, a magnetic model of a source of magnetic interference, for example a drill bit, is modeled to relate the observed magnetic field to the position of the source of magnetic interference. Further, the inferred position of the source of magnetic interference can be utilized to determine the tool-face angle and bend angle of the steering tool, and the azimuth of the upper and lower portions of the steering tool.

In one or more embodiments, the method 200 can be performed in real-time to control the path of the drill bit during operation. In the depicted example, magnetometer and accelerometer data can be acquired in step 400 to be input into the model established in step 300. Data can be continuously acquired to allow for continuous calculation of orientation parameters or to enhance the accuracy of the orientation parameters. In one or more embodiments, data is acquired from the first, second, and third survey instrument packages over a desired period of time. For example, data can be acquired over at least 10 revolutions of the drill string, and at various tool-face angles. Further, the magnetometer and accelerometer data can be synchronized. Furthermore, data between the first, second, and third survey instrument packages can be synchronized. Magnetic field data from the first, second, and third survey instrument packages can each include measurements of the three components of the magnetic field, resulting in nine magnetic field measurements at each tool-face angle. Similarly, gravitational field data from the first, second, and third survey instrument packages can each include measurements of the three components of the gravitational field, resulting in nine gravitational field measurements at each tool-face angle.

In the depicted example, in step 500, the model established in step 300 is solved with the data acquired in step 400 to determine the tool-face angle and bend angle of the steering tool, and the azimuth of the upper and lower portions of the steering tool. Various solving techniques can be utilized to solve for the desired orientation parameters, including, but not limited to binary search solving methods. In one or more embodiments, magnetic gradient tensors are utilized to simplify solving operations. Optionally, multiple station analysis techniques are utilized.

In the depicted example, in step 600, the inferred or modeled orientation parameters can be utilized for controlling the direction of drilling. The modeled orientation parameters can be applied to the rotary steerable system to determine a present orientation of the rotary steerable system and the drill bit. Based on the present orientation, an operator and/or a control scheme can maintain or adjust the operational parameters of the rotary steerable system to create a desired drilling path.

Figure 4:
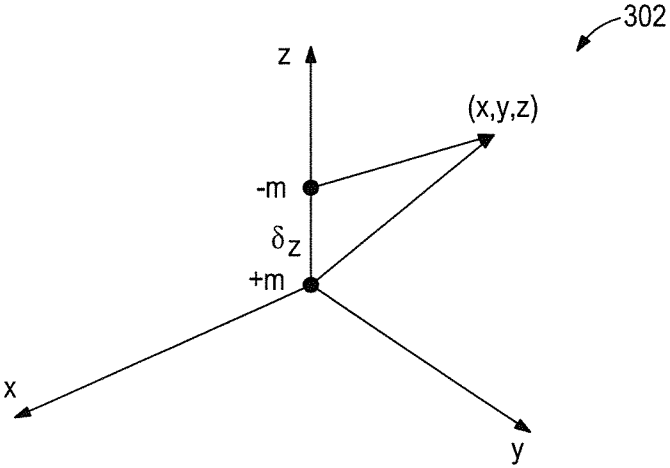
FIG. 4 illustrates a derivation of a model used for magnetic interference, according to one or more embodiments of the present disclosure.

FIG. 4 illustrates a derivation of a model used for magnetic interference, according to one or more embodiments of the present disclosure. In one or more embodiments, a simple model for the magnetic field of the drill bit is desired. However, in certain applications, a simple dipole field model may not adequately model the interference expected from drill bits.

In the depicted example, a model for a magnetic field can be a generalization of a dipole field. In one or more embodiments, the field is treated as if it is composed of two magnetic charges separated by a finite distance. It is noted that a magnetic dipole is typically conceived as either due to two magnetic charges of opposite polarity and an infinitesimal separation, or a magnetic field arising from an infinitesimal loop of current. Diagram 302 shows two charges in an (x,y,z) coordinate system separated by a distance δz.

$$\overline{B}(x, y, z) = \frac{m}{(x^2 + y^2 + (z - \delta z)^2)^{\frac{3}{2}}}\left(x \cdot \hat{i} + y \cdot \hat{j} + (z - \delta z) \cdot \hat{k}\right) - \frac{m}{(x^2 + y^2 + z^2)^{\frac{3}{2}}}\left(x \cdot \hat{i} + y \cdot \hat{j} + z \cdot \hat{k}\right) \tag{1}$$

Equation 1 illustrates an equation of the field due to the magnetic "charges" as illustrated in FIG. 4, at an observation point (x,y,z), according to one or more embodiments of the present disclosure. In one or more embodiments, the field can be expressed as shown in Equation 1, where i is the unit vector along the x-axis, j is the unit vector along the y-axis, and $\hat{k}$ is the unit vector along the z-axis.

In the depicted example, supposing that δz is infinitesimal, and that a line of alternating magnetic charges is set up along the z-axis from (0,0,z1) to (0,0,z2), the overlapping positive and negative charges will cancel each other out, resulting in a field that will be of the same form as shown in Equation 1.

$$Bx[x, y, z] = m \cdot (x - x0)\left(\frac{1}{((x - x0)^2 + (y - y0)^2 + (z - z2)^2)^{\frac{3}{2}}} - \frac{1}{((x - x0)^2 + (y - y0)^2 + (z - z1)^2)^{\frac{3}{2}}}\right) \tag{2}$$

$$By[x, y, z] = m \cdot (x - x0)\left(\frac{1}{((x - x0)^2 + (y - y0)^2 + (z - z2)^2)^{\frac{3}{2}}} - \frac{1}{((x - x0)^2 + (y - y0)^2 + (z - z2)^2)^{\frac{3}{2}}}\right)$$

$$\begin{aligned} Bz[x, y, z] = m \cdot & \left(((x - x0)^2 + (y - y))^2\right) \\ & \left(-(z - z1)\sqrt{(x - x0)^2 + (y - y0)^2 + (z - z2)^2} + \sqrt{(x - x0)^2 + (y - y0)^2 + (z - z1)^2}\,(z - z2)\right) + \\ & (z - z1)(z - z2)\left(\sqrt{(x - x0)^2 + (y - y0)^2 + (z - z1)^2}\,(z - z1) - \sqrt{(x - x0)^2 + (y - y0)^2 + (z - z2)^2}\,(z - z2)\right)\Big) \Big/ \\ & (((x - x0)^2 + (y - y0)^2 + (z - z1)^2)((x - x0)^2 + (y - y0)^2 + (z - z2)^2))^{\frac{3}{2}} \end{aligned}$$

Equation 2 illustrates an equation of the field, according to one or more embodiments of the present disclosure. In the depicted example, the equation shown in Equation 2 represents the field if the line of the magnetic charge is parallel to the z-axis, but offset by x0 along the x-axis and y0 along the y-axis.

In the depicted example, this line of magnetic charge is parallel to the axis of the drill bit. If β is the bend angle of the lower portion of the rotary steerable system relative to the upper portion, and if is the tool-face angle of the plane containing the lower portion, then the field as measured by the first and second survey instrument packages will be a rotated version of the field described in Equation 2.

In one or more embodiments, the relationship between the first and second survey instrument packages and the field is taken into account using two coordinate rotations. The coordinate rotation can bring the charge distribution closer to the first and second survey instrument packages. Further, the effect of this angular offset on the relationship between the tool-face angles of the three sets of sensors may be negligible to the first order of the bend angle.

In one or more embodiments, the rotation can be performed after translating by (x0,y0) orthogonal to the third survey instrument package tool-axis (z-axis) to rotate the line of the magnetic charge about the second survey instrument package by angle β and then to rotate about the second survey instrument package by angle ξ. In the depicted example, the rotation of the points (x0,y0,z1) and (x0,y0,z2) are included in this process, wherein the equations shown in Equation 2 are applied to measurements above the flexible collar, while measurements made at the third survey instrument package below the flexible collar are directly rotated into the coordinates of the second survey instrument package.

In the depicted example, as the model is established, it is assumed that β and ξ are not known. Subsequent solving routines may determine constants $\mathcal{B}$ and X, the angle the line of magnetic charge makes with the upper portion, and the tool-face angle of the plane containing the line of magnetic charge and a line parallel to the tool-axis of the upper portion with respect to the x-axis of the second survey instrument package. In one or more embodiments, the bend angle β can be solved and utilized as a model parameter using geometric solving routines, such as the rotation of coordinates.

In one or more embodiments, additional or alternative solving routines can be utilized for comparison, validation, averaging as a weighted sum, or refining of the bend angle solution. For example, the bend angle β may be solved by using gravitational field measurements. In one or more embodiments, the inner product of the gravitational field measured in the first and second survey instrument packages with the gravitational field measured at the same time in the third survey instrument package. The resulting inner product is equal to the square of the magnitude of the gravitational field multiplied by the cosine of the bend angle, allowing for the bend angle β to be solved.

Optionally, magnetic interference can be removed or calibrated to improve the accuracy of the magnetic model. For example, magnetic interference from the drill bit can be calibrated prior entering the wellbore. Further, magnetization of the drill bit from casing shoes can be considered and further modeled. Alteration of the magnetic field distribution of the drill bit during operation can be considered in modeling. Similarly, furthermore, magnetic fields from electrical currents can be measured and removed. Twisted pair wiring can be utilized to remove magnetic interference attributed to electrical currents. Further, in one or more embodiments, magnetic interference from additional downhole components can be removed by measurement and calibration.

Figure 5:
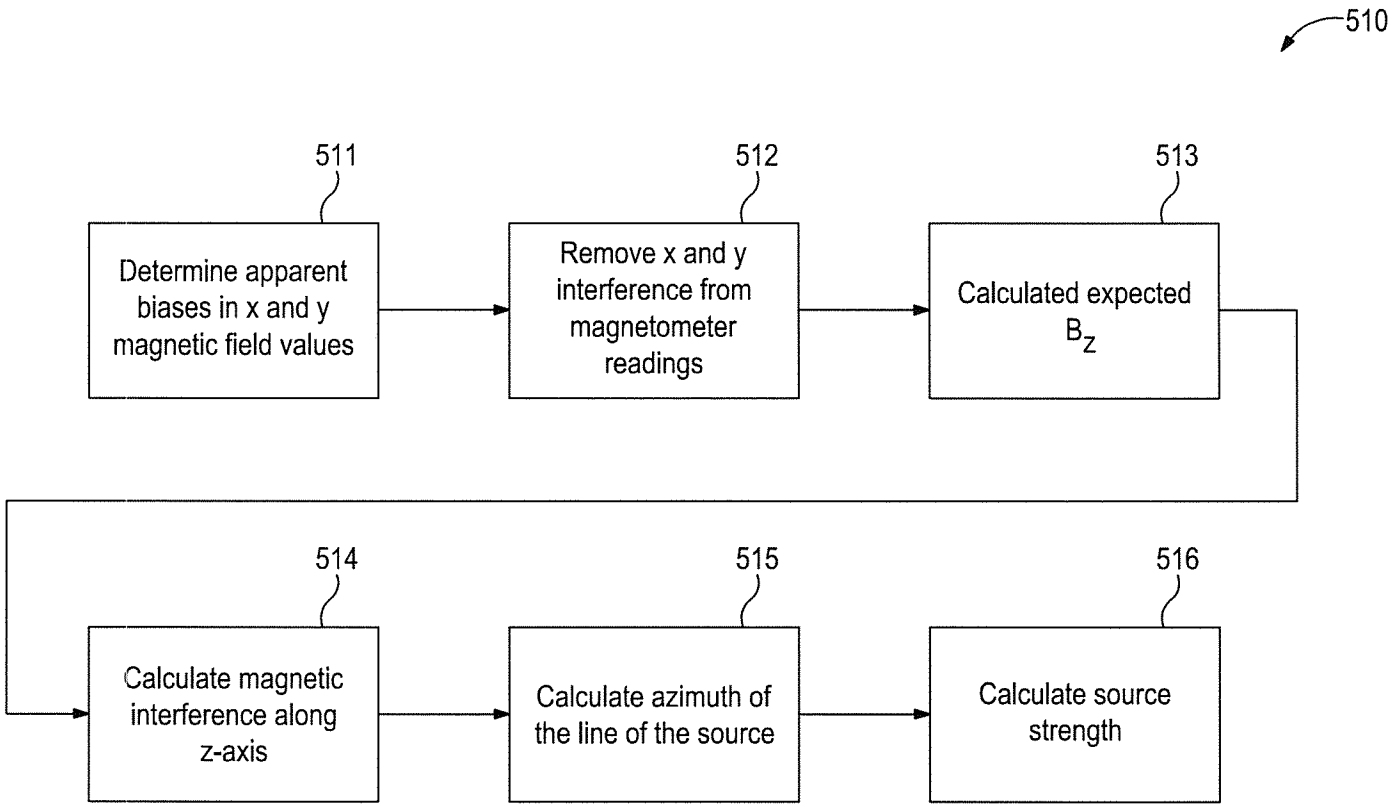
FIG. 5 illustrates a first portion of a method to solve for orientation parameters of the rotary steerable system, according to one or more embodiments of the present disclosure.

FIG. 5 illustrates a first portion of a method to solve for orientation parameters of the rotary steerable system, according to one or more embodiments of the present disclosure. In the depicted example, the method 510 utilizes measurements from the third survey instrument package to calculate initial parameters for additional analysis, including the initial azimuth of the line of the source and the magnetic source strength. In one or more embodiments, it is assumed that the dominant magnetic interference from the drill bit will be axial.

In step 511, data from the third survey instrument package is analyzed to determine the apparent biases in the x and y magnetic field values. In one or more embodiments, multiple station analysis techniques are utilized to correct for the effects of cross-axial magnetic interference to determine the apparent biases in the x and y magnetic field values. Further, it is assumed that inclination is constant; therefore, iterative aspects of the analysis technique may not be utilized. Instead, a least squares fit can be used to determine the apparent biases in the x and y magnetic field values. In step 512, the calculated apparent biases are removed from the x and y magnetic value readings.

In step 513, in one or more embodiments, the total magnetic field value can be utilized to calculate the expected z-axis value of the magnetic field. In step 514, knowledge of the magnitude of the local magnetic field can be used to determine the z-axis interference. In one or more embodiments, while two solutions may be possible, a solution may be selected based only on a general knowledge of the heading of the drill bit.

In step 515, a preliminary azimuth of the line of the source can be calculated using multiple station analysis techniques, as previously described. In one or more embodiments, what are known as "short-collar methods" are applied, wherein knowledge of Bz is not necessary. Further, it may be assumed that the azimuth of the line of the source is the azimuth of the drill bit.

In step 516, the source strength is calculated. In one or more embodiments, the upper and lower locations of the source are initially assumed in a first iteration to calculate the source strength. An upper location of the source may be initially selected as the sum of (0.9*bit length) and the distance from the drill bit to the third survey instrument package. Further, a lower location of the source may be initially selected as the sum of (0.1*bit length) and the distance from the drill bit to the third survey instrument package. Other suitable initial bounds can be selected. In one or more embodiments, the source position can be iteratively refined using solving techniques, such as a binary search.

Figure 6:
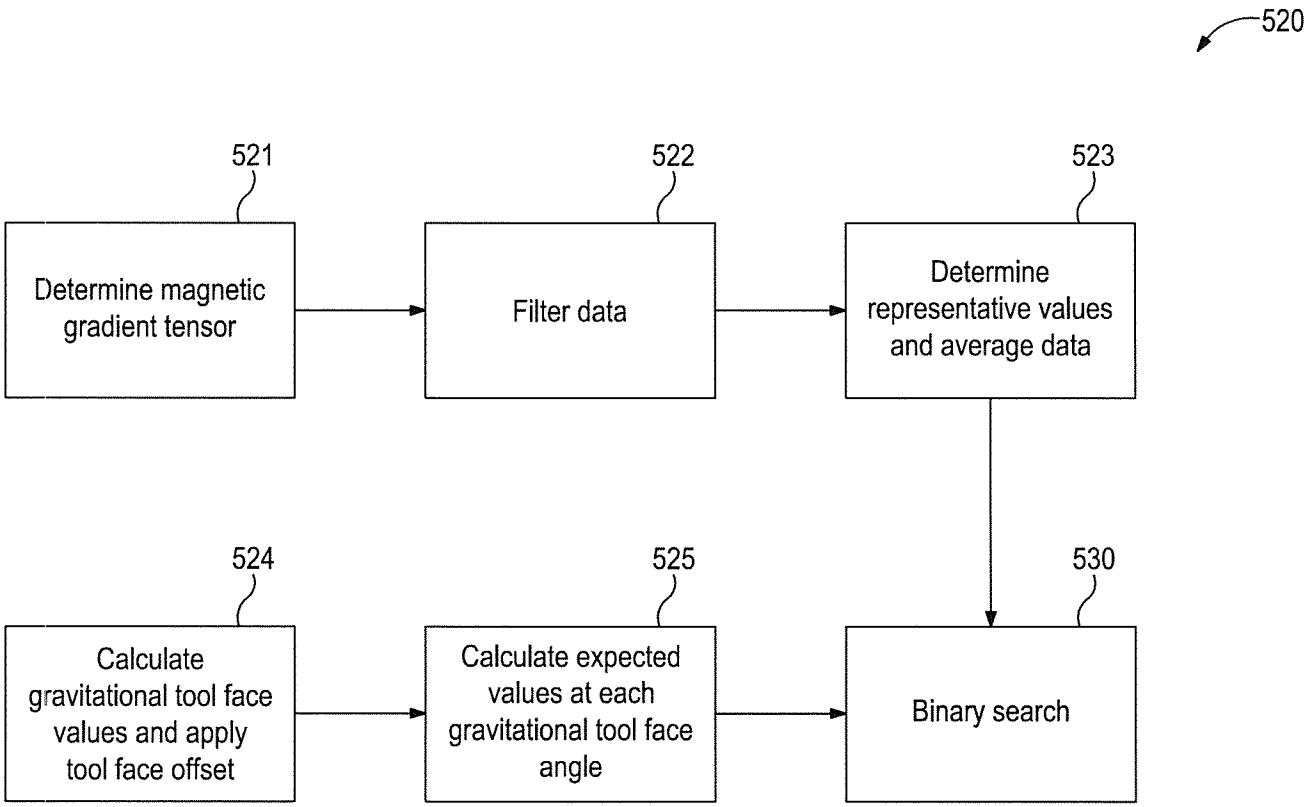
FIG. 6 illustrates a second portion of a method to solve for orientation parameters of the rotary steerable system, according to one or more embodiments of the present disclosure.

FIG. 6 illustrates a second portion of a method to solve for orientation parameters of the rotary steerable system, according to one or more embodiments of the present disclosure. In the depicted example, the method 520 utilizes the realization that the components of the magnetic gradient tensor are independent of the earth's magnetic field, since the earth's magnetic field is uniform on the scale of borehole equipment. Therefore, in one or more embodiments, the components of the magnetic gradient tensor depend only on the properties of the interfering field. Further, the three measured components of the magnetic field tensor can be used to infer the three components of the magnetic field tensor that could not be measured directly, as described below. In step 521, gradient values $B_{xz}$, $B_{yz}$, and $B_{zz}$ are calculated from the measured magnetic field data for each sample at each desired time. In step 522, data spikes are edited and data is filtered to remove erroneous or noisy data from the gradient values.

In step 523, using linear regression, representative values of $B_{xx}$, $B_{yy}$, and $B_{xy}$ are determined for the given time interval. Further, $B_{xz}$, $B_{yz}$, and $B_{zz}$ are each averaged across the time interval to produce a single gradient value for each parameter.

In step 530, the assumed model is solved using the magnetic field gradient to determine and refine the model parameters, including the bend angle, the tool-face angle of the bend, and the azimuth of the upper and lower portions. In the depicted example, a binary search method is utilized to determine a solution for the model.

In one or more embodiments, additional information from the first and second survey instrument packages can be provided to improve the solution to be calculated in step 530. Optionally, simultaneous or near simultaneous to the acquisition of data from the third survey instrument package in the lower portion of the rotary steerable system, a continuous stream of synchronized data can be acquired from the first and second survey instrument packages in the upper portion of the rotary steerable system. In one or more embodiments, the data between the survey instrument packages is synchronized to within 1 to 10 milliseconds.

In step 524, for each set of synchronized data from the upper portion, the gravitational tool-face angle value is determined and a tool-face offset is determined. In one or more embodiments, the gravitational tool-face angle value and a tool-face offset is determined using the second survey instrument package as a reference.

In step 525, utilizing the gravitational measurements and the initial magnetic source strength data from the third survey instrument package, the expected values of $B_{xx}$, $B_{yy}$, $B_{xy}$, $B_{xz}$, $B_{yz}$, and $B_{zz}$ at each gravitational tool-face angle are calculated. In one or more embodiments, the field gradients are calculated using a linear regression based on constraints imposed on magnetostatic fields. Constraints on magnetostatic fields can include, but are not limited to (1) the divergence of the field is zero (also stated as the trace of the gradient tensor vanishes), (2) the gradient tensor is symmetric, (3) $B_{xx}B_{yy}+B_{xx}B_{zz}+B_{yy}B_{zz}-B_{xy}^2-B_{xz}^2-B_{yz}^2$ is invariant under an arbitrary rotation of the reference frame, (4) the determinant of the gradient tensor vanishes, and (5) the inner product of the magnetic field and the gravitational field is the magnitude of each field multiplied by the cosine of the magnetic dip angle at the point where the field is measured.

Figure 7:
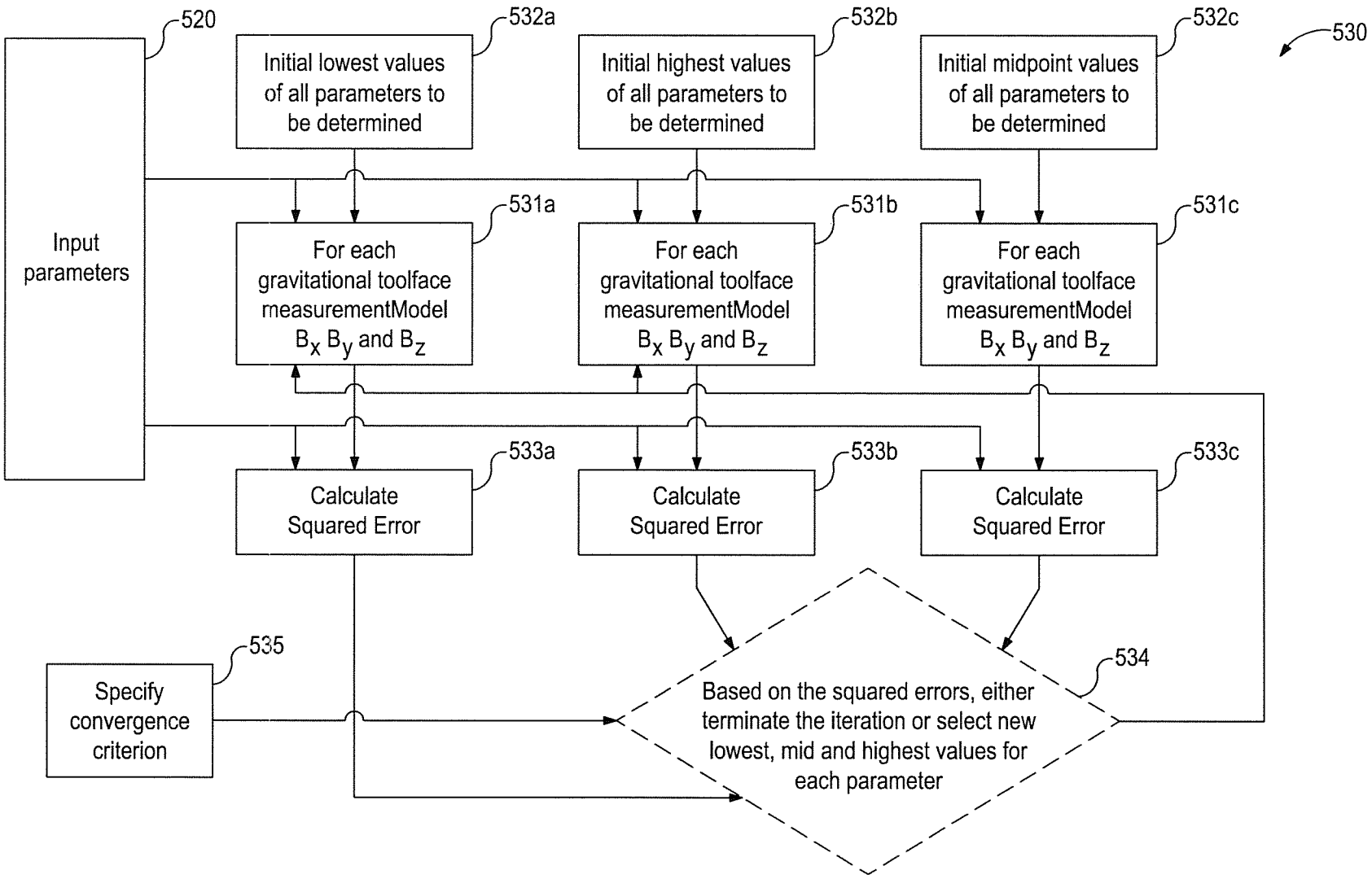
FIG. 7 illustrates a binary search method, according to one or more embodiments of the present disclosure.

FIG. 7 illustrates a binary search method, according to one or more embodiments of the present disclosure. In the depicted example, a binary search 530 is carried out to solve the unknown parameters of the magnetic model using the input parameters from the second portion of the method 520. In one or more embodiments, the binary search method 530 described herein is utilized. Further, modifications to the binary search method can be utilized. Furthermore, other suitable solving methods can be utilized.

In the depicted example, for each parameter to be solved, a minimum value 532*a* and a maximum value 532*b* establish a range of possible solutions. In one or more embodiments, a midpoint value 532*b* is further specified for each parameter range.

In the depicted example, the magnetic field is synthesized by entering the parameters based on the calculated magnetic gradient into the equations that define the modeled magnetic field, using the minimum value 532*a*, the maximum value 532*b*, and the midpoint value 532*c* of each parameter to be solved.

In the depicted example, the resulting respective synthesized magnetic fields are compared to the observed magnetic field 531*a*, 531*b*, 531*c* provided at a respective gravitational tool-face measurement.

In the depicted example, the error between the synthesized values and the observed values is calculated. In one or more embodiments, the error between each respective synthesized field and the observed field is calculated and squared to determine a squared error 533*a*, 533*b*, 533*c* corresponding to each initial value.

In the depicted example, the squared errors 533*a*, 533*b*, 533*c* of each respective solution 532*a*, 532*b*, 532*c* are compared. In one or more embodiments, for each parameter, the solution with the least error is identified. A new solution interval can be defined between the solution with the lowest error and the midpoint (i.e. between the minimum value 532*a* and the midpoint value 532*c*, or between the midpoint value 532*c* and the maximum value 532*b*).

In one or more embodiments, in step 534, the intervals containing the solution are selected and reduced by a convergence factor specified in step 535. The convergence factor can be 0.5 but can range up to 0.9 for complex searches. Further, the binary search 530 can iterate until the solutions converge.

Figure 8:
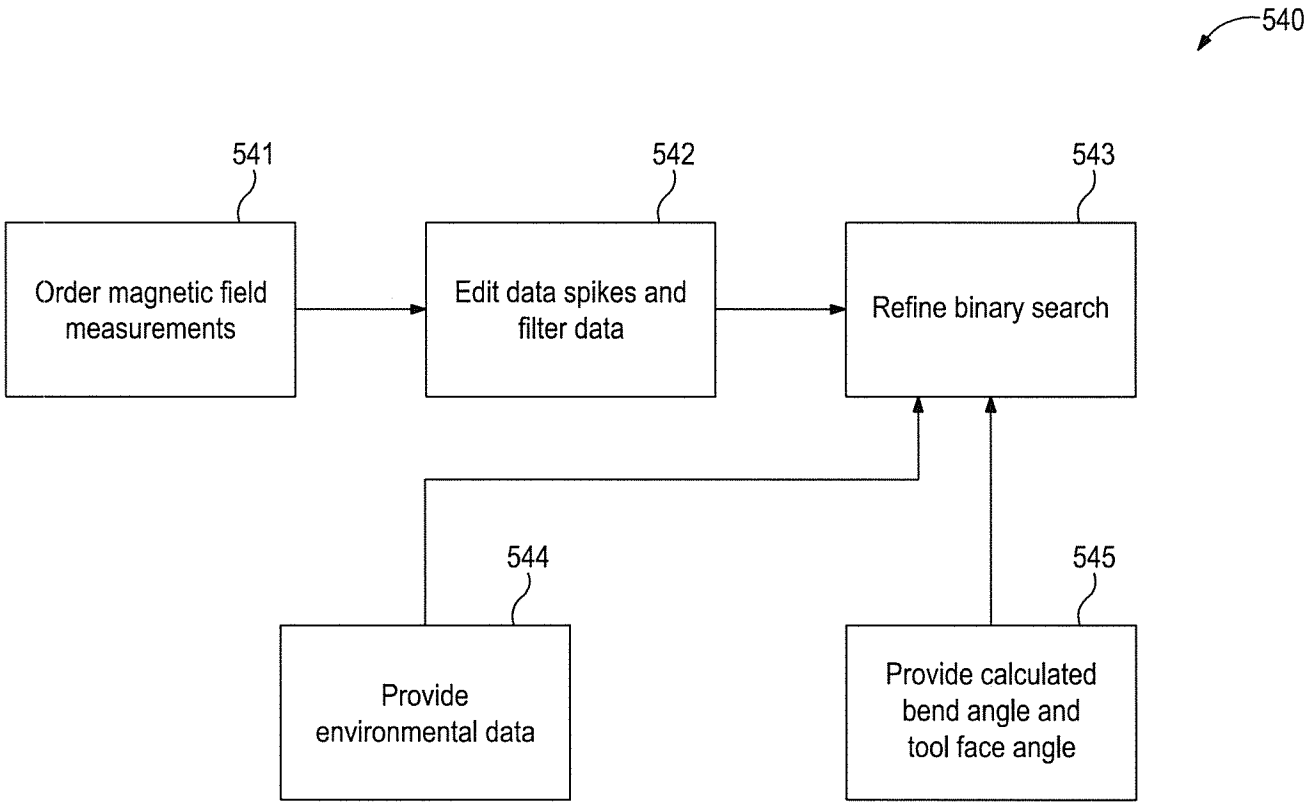
FIG. 8 illustrates a third portion of a method to solve for orientation parameters of the rotary steerable system, according to one or more embodiments of the present disclosure.

FIG. 8 illustrates a third portion of a method to solve for orientation parameters of the rotary steerable system, according to one or more embodiments of the present disclosure. In the depicted example, the third portion of method 540 can utilize the magnetic field values measured in the first and second survey instrument packages to refine the modeled values calculated in the binary search 530.

In step 541, the measurements from the first and second survey instrument packages are ordered corresponding to the gravitational tool-face measurements. In step 542, the data can be prepared for further analysis by removing noise spikes and bandpass filtering the data. In step 543, a binary search technique can be utilized to compare the observed magnetic field values measured by the first and second survey instrument packages to the modeled solution values. If a systematic error is detected between the inferred values and the measured values, a further iteration of the solving method can be carried out to minimize mean square error between terms.

In one or more embodiments, in step 544, additional environmental data can be provided to the solving routine, including providing known properties of the earth's magnetic field, a total magnetic field, and magnetic dip to compare against the modeled solution.

In one or more embodiments, in step 545, the previous solutions for the bend angle and tool-face angle can be provided in the coordinates of the second survey instrument package to be compared against the modeled solution in an original reference system.

In one or more embodiments, a gradient tensor measured from the coordinates of the second survey instrument package is utilized with the solving methods described herein. Advantageously, the use of gradient measurements allows the earth's magnetic field to drop out of the gradient, leaving only contributions from the interfering field. Magnetic field gradient components $B_{xz}$, $B_{yz}$, and $B_{zz}$ are directly measured from the sensors disposed on the rotary steerable system. In one or more embodiments, it is useful to determine other components of the tensor using tensor invariants, as this makes it possible to compare the observed gradient tensor with the gradient tensor calculated using the inferred model for the interfering field.

$$\begin{pmatrix} Bxx0 & Bxy0 & Bxz0 \\ Bxy0 & Byy0 & Byz0 \\ Bxz0 & Byz0 & Bzz0 \end{pmatrix} \tag{3}$$

Equation 3 illustrates a magnetic field tensor at a gravitational tool-face angle $\psi=0$, according to one or more embodiments of the present disclosure. In one or more embodiments, an assumption is made that during a period in which N measurements can be made, the position of the drill bit has not changed enough to significantly alter the magnetic field as received at the first or second survey instrument package.

$$\begin{pmatrix} Bxx & Bxy & Bxz \\ Byx & Byy & Byz \\ Bzx & Bzy & Bzz \end{pmatrix} = \begin{pmatrix} \cos[\phi] & \sin[\phi] & 0 \\ -\sin[\phi] & \cos[\phi] & 0 \\ 0 & 0 & 1 \end{pmatrix} \cdot \begin{pmatrix} Bxx0 & Bxy0 & Bxz0 \\ Bxy0 & Byy0 & Byz0 \\ Bxz0 & Byz0 & Bzz0 \end{pmatrix} \cdot \begin{pmatrix} \cos[\phi] & \sin[\phi] & 0 \\ \sin[\phi] & \cos[\phi] & 0 \\ 0 & 0 & 1 \end{pmatrix} \tag{4}$$

Equation 4 illustrates a magnetic field tensor at a gravitational tool-face angle $\psi$ as viewed from the upper portion of the rotary steerable system, according to one or more embodiments of the present disclosure.

$$\begin{pmatrix} Bxx & Bxy & Bxz \\ Byx & Byy & Byz \\ Bzx & Bzy & Bzz \end{pmatrix} = \begin{pmatrix} Bxx0\cos[\phi]^2 + Byy0\sin[\phi]^2 + Bxy0\sin[2\phi] & \frac{1}{2}(2Bxy0\cos[2\phi] + (-Bxx0 + Byy0)\sin[2\phi]) & Bxz0\cos[\phi] + Byz0\sin[\phi] \\ \frac{1}{2}(2Bxy0\cos[2\phi] + (-Bxx0 + Byy0)\sin[2\phi]) & Byy0\cos[\phi]^2 - Bxy0\sin[2\phi] + Bxx0\sin[\phi]^2 & Byz0\cos[\phi] - Bxz0\sin[\phi] \\ Bxz0\cos[\phi] + Byz0\sin[\phi] & Byz0\cos[\phi] - Bxz0\sin[\phi] & Bzz0 \end{pmatrix} \tag{5}$$

Equation 5 illustrates an expanded magnetic field tensor at a gravitational tool-face angle $\psi$ as viewed from the upper portion of the rotary steerable system, according to one or more embodiments of the present disclosure. In one or more embodiments, since magnetic field gradient components $B_{xz}$, $B_{yz}$, and $B_{zz}$ are measured, the magnetic field tensor can be rewritten.

$$\begin{pmatrix} Bxx & Bxy & Bxz \\ Byx & Byy & Byz \\ Bzx & Bzy & Bzz \end{pmatrix} = \begin{pmatrix} Bxx0\cos[\phi]^2 + Byy0\sin[\phi]^2 + Bxy0\sin[2\phi] & \frac{1}{2}(2Bxy0\cos[2\phi] + (-Bxx0 + Byy0)\sin[2\phi]) & Bxy \\ \frac{1}{2}(2Bxy0\cos[2\phi] + (-Bxx0 + Byy0)\sin[2\phi]) & Byy0\cos[\phi]^2 - Bxy0\sin[2\phi] + Bxx0\sin[\phi]^2 & Byz \\ Bxz & Byz & Bzz0 \end{pmatrix} \tag{6}$$

Equation 6 illustrates the magnetic field of Equation 5 with measured variables entered, according to one or more embodiments of the present disclosure. In the depicted example, the "0" has been retained on the B term, because the $B_{zz}$ term should not vary under rotation about the tool-face angle, as any variation would be due to noise, so an overall average can be used for $B_{zz}$ or $B_{zz}0$.

$$IC = -Bxx0(Byz \cdot \cos[\phi])^2 - \tag{7}$$

-continued $$Byy0(Bxz\cdot\cos[\phi]-Byz\cdot\sin[\phi])^2+Bxy0(2BxzByz\cos[2\phi]+Bxz^2\sin[2\phi]-Byz^2\sin[2\phi])+Bzz0\cdot(Bxx0Byy0-Bxy0^2)$$

Equation 7 illustrates the determinant of the magnetic field tensor of Equation 6, according to one or more embodiments of the present disclosure. In one or more embodiments, values of the determinant (IC) obtained at different gravitational tool-face angles are subtracted to define a new function that should vanish, since IC is invariant under rotation, resulting in a homogenous equation. In one or more embodiments, to convert the equation to an inhomogeneous equation, the equation will be divided by one of the coefficients $B_{xx}0$, $B_{yy}0$, or $B_{xy}0$.

In the depicted example, a division by $B_{xx}0$ is performed, while parallel calculations utilizing $B_{yy}0$, or $B_{xy}0$ may be performed to cross-check the results. Assuming N measurements, the determinant is rewritten.

$$IC_1=-Bxx0\cup[Bxz_i,Byz_i,\emptyset_i]+Byy0\cdot W1[Bxz_i,\emptyset_i]+Bxy0\cdot W2[Bxz_i,Byz_i,\emptyset_i]+Bzz0\cdot(Bxx0\cdot Byy0\cdot Bxy0^2)$$

$$\emptyset[Bxz,Byz,\emptyset]\equiv(Byz\cdot\cos[\emptyset]+Bxz\cdot\sin[\emptyset])^2$$

$$W1[Bxz,Byz,\emptyset]\equiv-(Bxz\cdot\cos[\emptyset]-Byz\cdot\sin[\emptyset])^2$$

$$W2[Bxz,Byz,\emptyset]\equiv2BxzByz\cos[2\cup]+Bxz^2\sin[2\cup]-Byz^2\sin[2\cup] \quad (8)$$

Equation 8 illustrates the determinant of the magnetic field tensor of Equation 7, defining functions of i and known values, according to one or more embodiments of the present disclosure. In the depicted example, i is an index, wherein the index identifies a particular tool-face angle and a corresponding field measurement measured at the same time.

$$IC_i-IC_j=-Bxx0\cdot(\cup[Bxz_i,Byz_i,\emptyset_i]-\cup[Bxz_j,Byz_j,\emptyset_j]+Byy0\cdot(W1[Bxz_i,Byz_i,\emptyset_i]-W1[Bxz_j,Byz_j,\emptyset_j]+Bxy0\cdot W2[Bxz_i,Byz_i,\emptyset_i]-W2[Bxy_j,Byz_j,\emptyset_j]) \quad (9)$$

In one or more embodiments, a least squares process is initiated beginning with an equation such as that illustrated in Equation 9, wherein i≠j. Equation 9 illustrates the determinant of the magnetic field tensor wherein i≠j, according to one or more embodiments of the present disclosure.

In the depicted example, by providing another definition of variables and adding a constant $\mathcal{C}$, wherein $\mathcal{C}$ may be equal to 0, the determinant can be simplified.

$$Y_{ij}=\mathcal{A}\cdot X1_{ij}+\mathcal{B}\cdot X2_{ij}+\mathcal{C}+\in_{ij} \quad (10)$$

Equation 10 illustrates a simplified determinant equation, according to one or more embodiments of the present disclosure. In the depicted example, $\in_{ij}$ represents random noise.

$$Y_{ij}\equiv\cup[Bxz_i,Byz_i,\emptyset_i]-\cup[Bxz_j,Byz_j,\emptyset_j]$$

$$X1_{ij}\equiv W1[Bxz_i,Byz_i,\emptyset_i]-W1[Bxz_j,Byz_j,\emptyset_j]$$

$$X2_{ij}\equiv W2[Bxz_i,Byz_i,\emptyset_i]-W2[Bxz_j,Byz_j,\emptyset_j] \quad (11)$$

Equation 11 illustrates the unknown variables in the equation of Equation 10, according to one or more embodiments of the present disclosure. In one or more embodiments, a standard least squares technique can be used to solve for $\mathcal{A}$, $\mathcal{B}$, and $\mathcal{C}$. After the constants $\mathcal{A}$, $\mathcal{B}$, and $\mathcal{C}$ are solved, the sought gradient terms $B_{yy}0$, $B_{xx}0$, and Bzz0 can be solved.

$$Byy0=Bxx0\cdot\mathcal{A} \quad (12)$$

$$Bxx0+Byy0=-Bzz0$$

$$Bxx0=-\frac{Bzz0}{(1+\mathcal{A})}$$

Equation 12 illustrates equations to solve for gradient terms, according to one or more embodiments of the present disclosure.

$$\prod=\sum_{i=1}^{N-1}\sum_{j=i+1}^{N}(Y_{ij}-(\mathcal{A}\cdot X1_{ij}+\mathcal{B}\cdot X2_{ij}+C+\in_{ij}))^2 \quad (13)$$

Equation 13 illustrates a least square technique to solve for $\mathcal{A}$, $\mathcal{B}$, and $\mathcal{C}$, according to one or more embodiments of the present disclosure.

$$\sum_{i=1}^{N-1}\sum_{j=i+1}^{N}X1_{ij}\cdot Y_{ij}=\sum_{i=1}^{N-1}\sum_{j=i+1}^{N}X1_{ij}\cdot(\mathcal{A}\cdot X1_{ij}+\mathcal{B}\cdot X2_{ij}+C+\in_{ij}) \quad (14)$$

$$\sum_{i=1}^{N-1}\sum_{j=i+1}^{N}X2_{ij}\cdot Y_{ij}=\sum_{i=1}^{N-1}\sum_{j=i+1}^{N}X2_{ij}\cdot(\mathcal{A}\cdot X1_{ij}+\mathcal{B}\cdot X2_{ij}+C+\in_{ij})$$

$$\sum_{i=1}^{N-1}\sum_{j=i+1}^{N}Y_{ij}=\sum_{i=1}^{N-1}\sum_{j=i+1}^{N}(\mathcal{A}\cdot X1_{ij}+\mathcal{B}\cdot X2_{ij}+C+\in_{ij})$$

Equation 14 illustrates partials of the equation of Equation 13 with respect to $\mathcal{A}$, $\mathcal{B}$ and $\mathcal{C}$, according to one or more embodiments of the present disclosure.

$$\begin{pmatrix} X1_{1,2} & X2_{1,2} & 1 \\ X1_{1,3} & X2_{1,3} & 1 \\ \dots & \dots & \dots \\ X1_{1,N} & X2_{1,N} & 1 \\ X1_{2,3} & X2_{2,3} & 1 \\ X1_{2,4} & X2_{2,4} & 1 \\ \dots & \dots & \dots \\ X1_{2,N} & X2_{2,N} & 1 \\ \dots & \dots & \dots \\ X1_{N-1,N} & X2_{N-1,N} & 1 \end{pmatrix}^T\cdot\begin{pmatrix} Y_{1,2} \\ Y_{1,3} \\ \dots \\ Y_{1,N} \\ Y_{2,3} \\ Y_{2,4} \\ \dots \\ Y_{2,N} \\ \dots \\ Y_{N-1,N} \end{pmatrix} \quad (15)$$

$$\begin{pmatrix} X1_{1,2} & X2_{1,2} & 1 \\ X1_{1,3} & X2_{1,3} & 1 \\ \dots & \dots & \dots \\ X1_{1,N} & X2_{1,N} & 1 \\ X1_{2,3} & X2_{2,3} & 1 \\ X1_{2,4} & X2_{2,4} & 1 \\ \dots & \dots & \dots \\ X1_{2,N} & X2_{2,N} & 1 \\ \dots & \dots & \dots \\ X1_{N-1,N} & X2_{N-1,N} & 1 \end{pmatrix}^T\cdot\begin{pmatrix} X1_{1,2} & X2_{1,2} & 1 \\ X1_{1,3} & X2_{1,3} & 1 \\ \dots & \dots & \dots \\ X1_{1,N} & X2_{1,N} & 1 \\ X1_{2,3} & X2_{2,3} & 1 \\ X1_{2,4} & X2_{2,4} & 1 \\ \dots & \dots & \dots \\ X1_{2,N} & X2_{2,N} & 1 \\ \dots & \dots & \dots \\ X1_{N-1,N} & X2_{N-1,N} & 1 \end{pmatrix}\cdot\begin{pmatrix} \mathcal{A} \\ \mathcal{B} \\ C \end{pmatrix}$$

Equation 15 illustrates a matrix solution of Equation 13, according to one or more embodiments of the present disclosure. In Equation 15, in one or more embodiments, it is assumed that the error terms drop out.

$$X \equiv \begin{pmatrix} X1_{1,2} & X2_{1,2} & 1 \\ X1_{1,3} & X2_{1,3} & 1 \\ \dots & \dots & \dots \\ X1_{1,N} & X2_{1,N} & 1 \\ X1_{2,3} & X2_{2,3} & 1 \\ X1_{2,4} & X2_{2,4} & 1 \\ \dots & \dots & \dots \\ X1_{2,N} & X2_{2,N} & 1 \\ \dots & \dots & \dots \\ X1_{N-1,N} & X2_{N-1,N} & 1 \end{pmatrix} Y \equiv \begin{pmatrix} Y_{1,2} \\ Y_{1,3} \\ \dots \\ Y_{1,N} \\ Y_{2,3} \\ Y_{2,4} \\ \dots \\ Y_{2,N} \\ \dots \\ Y_{N-1,N} \end{pmatrix} A \equiv \begin{pmatrix} \mathcal{A} \\ \mathcal{B} \\ C \end{pmatrix} \tag{16}$$

Equation 16 illustrates definitions for use with the matrix solution of Equation 15, according to one or more embodiments of the present disclosure. Equation 17 illustrates a simplified expression of the equation of Equation 15, according to one or more embodiments of the present disclosure.

$$X^T \cdot Y = (X^T \cdot X) \cdot A$$

$$A = (X^T \cdot X)^{-1} \cdot (X^T \cdot Y) \tag{17}$$

In Equation 17, in one or more embodiments, it is assumed that the error terms drop out.

$$\sum_{i=1}^{N-1} \sum_{j=i+1}^{N} X1_{ij} \cdot Y_{ij} = \sum_{i=1}^{N-1} \sum_{j=i+1}^{N} X1_{ij} \cdot (\mathcal{A} \cdot X1_{ij} + \mathcal{B} \cdot X2_{ij} + \epsilon_{ij}) \tag{18}$$

$$\sum_{i=1}^{N-1} \sum_{j=i+1}^{N} X2_{ij} \cdot Y_{ij} = \sum_{i=1}^{N-1} \sum_{j=i+1}^{N} X2_{ij} \cdot (\mathcal{A} \cdot X1_{ij} + \mathcal{B} \cdot X2_{ij} + \epsilon_{ij})$$

$$\sum_{i=1}^{N-1} \sum_{j=i+1}^{N} X1_{ij} \cdot Y_{ij} = \mathcal{A} \cdot \sum_{i=1}^{N-1} \sum_{j=i+1}^{N} X1_{ij} \cdot X1_{ij} + \mathcal{B} \cdot \sum_{i=1}^{N-1} \sum_{j=i+1}^{N} X1_{ij} \cdot X2_{ij}$$

$$\sum_{i=1}^{N-1} \sum_{j=i+1}^{N} X2_{ij} \cdot Y_{ij} = \mathcal{A} \cdot \sum_{i=1}^{N-1} \sum_{j=i+1}^{N} X2_{ij} \cdot X1_{ij} + \mathcal{B} \cdot \sum_{i=1}^{N-1} \sum_{j=i+1}^{N} X2_{ij} \cdot X2_{ij}$$

Equation 18 illustrates a simplified expression of Equation 14, according to one or more embodiments of the present disclosure. In Equation 18, $\mathcal{C}$ is optionally removed for computational simplicity. In one or more embodiments, $\mathcal{C}$ is 0.

$$\sum_{i=1}^{N-1} \sum_{j=i+1}^{N} X1_{ij} \cdot X2_{ij} = \sum_{i=1}^{N-1} \sum_{j=i+1}^{N} X2_{ij} \cdot X1_{ij} \tag{19}$$

Equation 19 illustrates a relationship in the expression of Equation 18, according to one or more embodiments of the present disclosure.

$$XY((1, 1)) \equiv \sum_{i=1}^{N-1} \sum_{j=i+1}^{N} X1_{ij} \cdot Y_{ij} \tag{20}$$

$$XY((2, 1)) \equiv \sum_{i=1}^{N-1} \sum_{j=i+1}^{N} X2_{ij} \cdot Y_{ij} \quad \Delta \equiv M((1, 1))M((2, 2)) - M((1, 2))^2$$

-continued $$M((1, 1)) \equiv \sum_{i=1}^{N-1} \sum_{j=i+1}^{N} X1_{ij} \cdot X1_{ij}$$

$$\begin{pmatrix} \mathcal{A} \\ \mathcal{B} \end{pmatrix} = \frac{A}{\Delta} \begin{pmatrix} M[[2, 2]] - M[[1, 2]] \\ -M[[2, 2]]M[[1, 2]] \end{pmatrix} \cdot \begin{pmatrix} XY[[1, 1]] \\ XY[2, 1]] \end{pmatrix}$$

$$M((2, 1)) \equiv \sum_{i=1}^{N-1} \sum_{j=i+1}^{N} X1_{ij} \cdot X2_{ij}$$

$$M((2, 1)) \equiv M((1, 2))$$

$$M((2, 2)) \equiv \sum_{i=1}^{N-1} \sum_{j=i+1}^{N} X2_{ij} \cdot X2_{ij}$$

Equation 20 illustrates definitions utilized in solving the expression of Equation 18, according to one or more embodiments of the present disclosure. In one or more embodiments, if A vanishes, a solution cannot be found and additional measurements may be needed.

$$\mathcal{A} = (M(2,2) \cdot XY(1,1) - M(1,2) \cdot XY(2,1))/\Delta$$

$$\mathcal{B} = (-M(1,2) \cdot XY(1,1) + M(1,1) \cdot XY(2,1))/\Delta \tag{21}$$

Equation 21 illustrates a solution to the constants A and B, according to one or more embodiments of the present disclosure. The relationships expressed in Equation 21 can be used to solve for the gradient terms.

Figure 9:
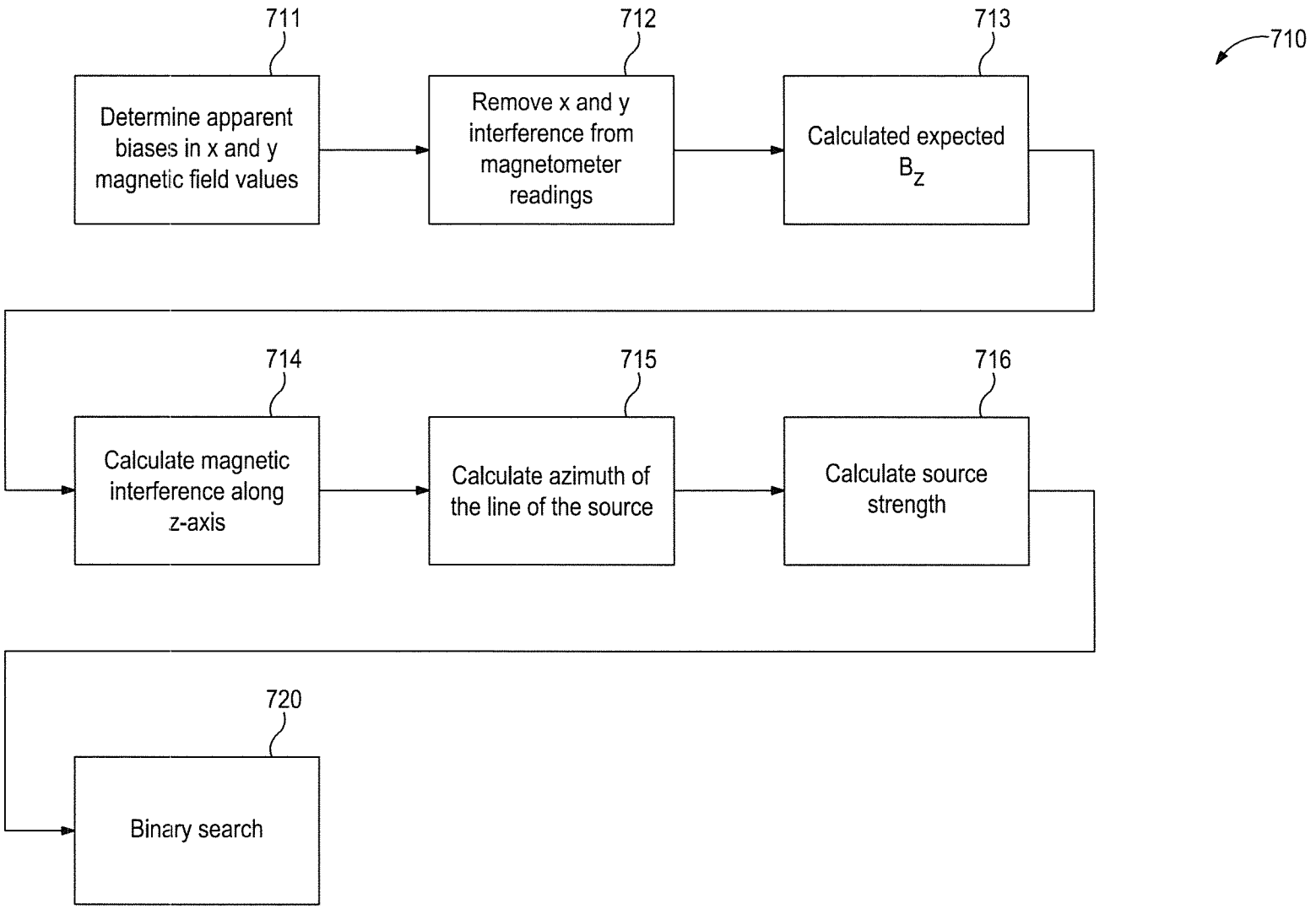
FIG. 9 illustrates a first portion of a method to solve for orientation parameters of the rotary steerable system, according to one or more embodiments of the present disclosure.

In one or more embodiments, a method to solve for orientation parameters can apply binary search techniques directly to the measured magnetic field parameters. FIG. 9 illustrates a first portion of a method to solve for orientation parameters of the rotary steerable system, according to one or more embodiments of the present disclosure. In the depicted example, the method 710 utilizes measurements from the third survey instrument package to calculate initial parameters for additional analysis, including the initial azimuth of the line of the source and the magnetic source strength. In one or more embodiments, it is assumed that the dominant magnetic interference from the drill bit will be axial.

In step 711, data from the third survey instrument package is analyzed to determine the apparent biases in the x and y magnetic field values. In step 712, the calculated apparent biases are removed from the x and y magnetic value readings.

In step 713, in one or more embodiments, the total magnetic field value can be utilized to calculate the expected z-axis value of the magnetic field. In step 714, optionally, knowledge of the magnitude of the local magnetic field can be used to determine the z-axis interference. Further, while two solutions may be possible, a solution may be selected based on a general knowledge of the heading of the drilling system.

In step 715, a preliminary azimuth of the line of the source can be calculated using multiple station analysis techniques, as previously described. In one or more embodiments, short-collar methods are applied. Further, it may be assumed that the azimuth of the line of the source is the azimuth of the drill bit.

In step 716, the source strength is calculated. In one or more embodiments, the upper and lower locations of the source are initially assumed in a first iteration to calculate the source strength. For example, an upper location of the source may be initially selected as the sum of (0.9*bit length) and the distance from the drill bit to the third survey instrument package. Further, a lower location of the source may be initially selected as the sum of (0.1*bit length) and the distance from the drill bit to the third survey instrument package. Other suitable initial bounds can be selected. In one or more embodiments, the source position can be iteratively refined using solving techniques, such as a binary search.

In step 720, the assumed model is solved using groups of magnetic field measurements to determine and refine the model parameters, including the bend angle, the tool-face angle of the bend, and the azimuth of the upper and lower portions. In the depicted example, a binary search method is utilized to determine a solution for the model.

Figure 10:
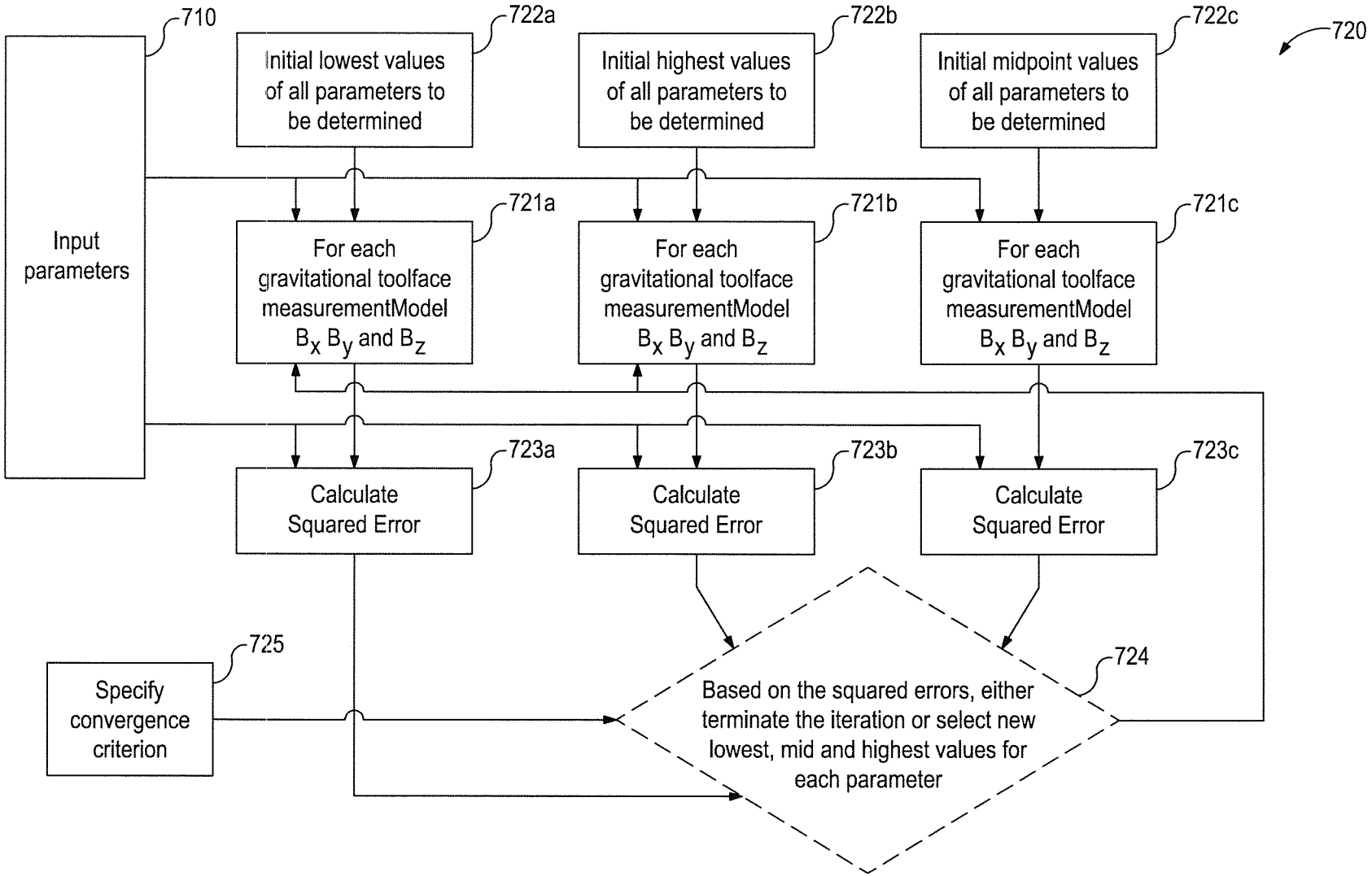
FIG. 10 illustrates a binary search method, according to one or more embodiments of the present disclosure.

FIG. 10 illustrates a binary search method, according to one or more embodiments of the present disclosure. In the depicted example, a binary search 720 is carried out to solve for the unknown parameters of the magnetic model using the input parameters from the first portion of the method 710. In one or more embodiments, the binary search method 720 described herein is utilized. Further, modifications to the binary search method can be utilized. Furthermore, other suitable solving methods can be utilized.

In one or more embodiments, it is not expected that the magnetic interference will appear to rotate significantly with the drill string, however deflection of the lower portion of the rotary steerable system can weakly violate this assumption. Therefore, the azimuth of the second survey instrument package may be included as the third unknown to be solved by the binary search or other solving routine. Optionally, the magnitude of the earth's magnetic field can be included as a constraint on the inversion process.

In the depicted example, for each parameter to be solved, a minimum value 722*a* and a maximum value 722*b* establish a range of possible solutions. In one or more embodiments, a midpoint value 722*b* is further specified for each parameter range.

In the depicted example, the magnetic field is synthesized by entering the parameters based on the groups of magnetic field measurements into the equations that define the modeled magnetic field, using the minimum value 722*a*, the maximum value 722*b*, and the midpoint value 722*c* of each parameter to be solved.

In the depicted example, the resulting respective synthesized magnetic field is compared to the observed magnetic field 721*a*, 721*b*, 721*c* provided at a respective gravitational tool-face measurement. In one or more embodiments, inclination and tool-face values measured or observed by the second survey instrument package can be utilized for comparison or validation.

In the depicted example, the error between the synthesized values and the observed values is calculated. In one or more embodiments, the error between each respective synthesized field and the observed field is calculated and squared to determine a squared error 723*a*, 723*b*, 723*c* corresponding to each initial value.

In the depicted example, the squared errors 723*a*, 723*b*, 723*c* of each respective solution 722*a*, 722*b*, 722*c* are compared. In one or more embodiments, for each parameter, the solution with the least error is identified. Optionally, a new solution interval is defined between the solution with the lowest error and the midpoint (i.e. between the minimum value 722*a* and the midpoint value 722*c*, or between the midpoint value 722*c* and the maximum value 722*b*).

In one or more embodiments, in step 724, the intervals containing the solution are selected and reduced by a convergence factor specified in step 725. Further the convergence factor can be 0.5 but can range up to 0.9 for complex searches. Furthermore, the binary search 720 can iterate until the solutions converge.

Figure 11:
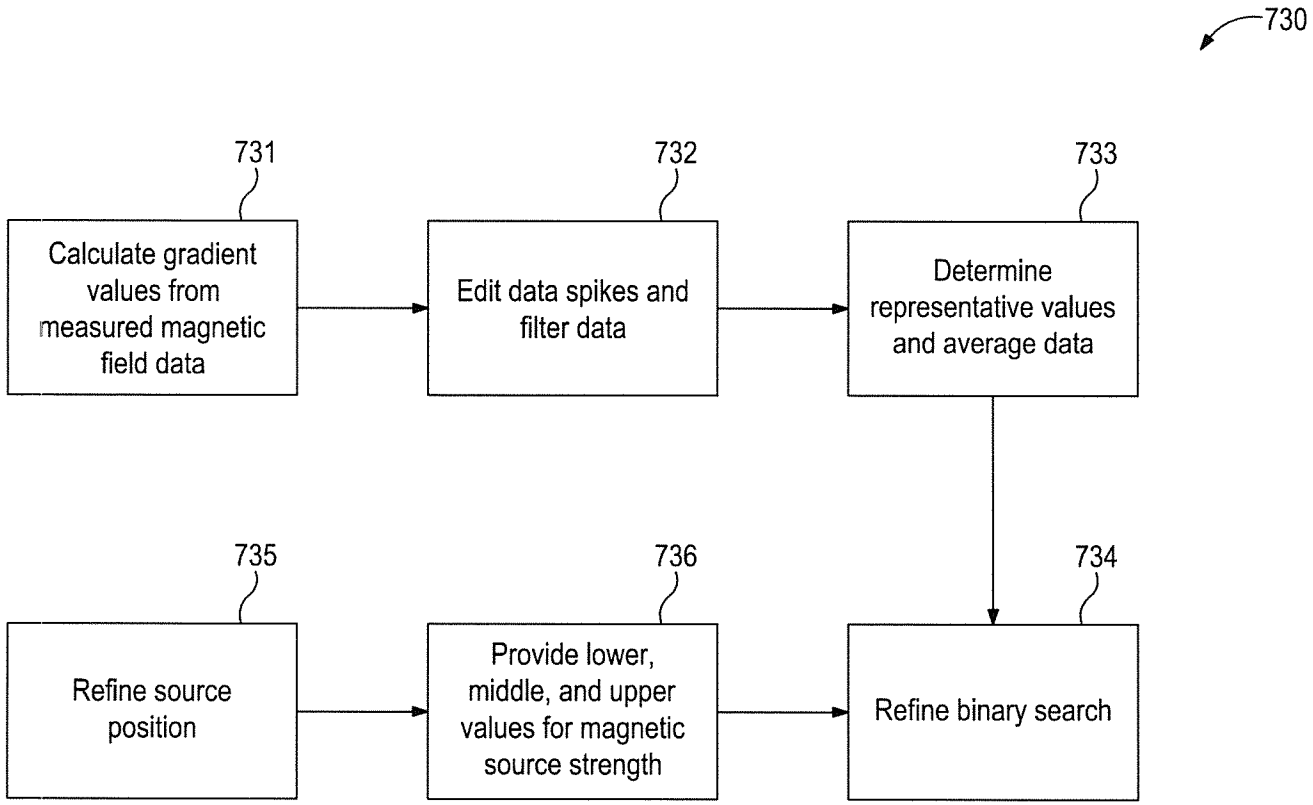
FIG. 11 illustrates a third portion of a method to solve for orientation parameters of the rotary steerable system, according to one or more embodiments of the present disclosure.

FIG. 11 illustrates a third portion of a method to solve for orientation parameters of the rotary steerable system, according to one or more embodiments of the present disclosure. In the depicted example, the method 730 utilizes the realization that the components of the magnetic gradient tensor are independent of the earth's magnetic field, since the earth's magnetic field is uniform on the scale of borehole equipment. Therefore, in one or more embodiments, the components of the magnetic gradient tensor depend only on the properties of the interfering field. In one or more embodiments, the three measured components of the magnetic field tensor are used to infer the three components of the magnetic field tensor that could not be measured directly, as described below. In step 731, the gradient values $B_{xz}$, $B_{yz}$, and $B_{zz}$ are calculated from the measured magnetic field data for each sample at each desired time. In step 732, data spikes are edited and data is filtered to remove erroneous or noisy data from the gradient values.

In step 733, using linear regression, representative values of $B_{xx}$, $B_{yy}$, and $B_{xy}$ are determined for the given time interval. Further, $B_{xz}$, $B_{yz}$, and $B_{zz}$ are each averaged across the time interval to produce a single gradient value for each parameter.

In step 734, a binary search technique can be utilized to compare the magnetic field gradient values to the modeled solution values to improve the calculated solutions. If a systematic error is detected between the inferred values and the gradient values, a further iteration of the solving method can be carried out to minimize mean square error between terms.

In step 735, the source position is refined. As previously described, in one or more embodiments, the upper and lower locations of the source are initially assumed to calculate the source strength. For example, an initial upper location of the source may be selected as the sum of (0.9*bit length) and the distance from the drill bit to the third survey instrument package. Further, an initial lower location of the source may be selected as the sum of (0.1*bit length) and the distance from the drill bit to the third survey instrument package. Other suitable bounds can be selected. In the depicted example, the source position can be solved using a binary search.

After determining a solution for the source position, in step 736, refined parameters for solving for the solution of the magnetic source strength can be determined and provided to the binary search in step 734.

Figure 12:
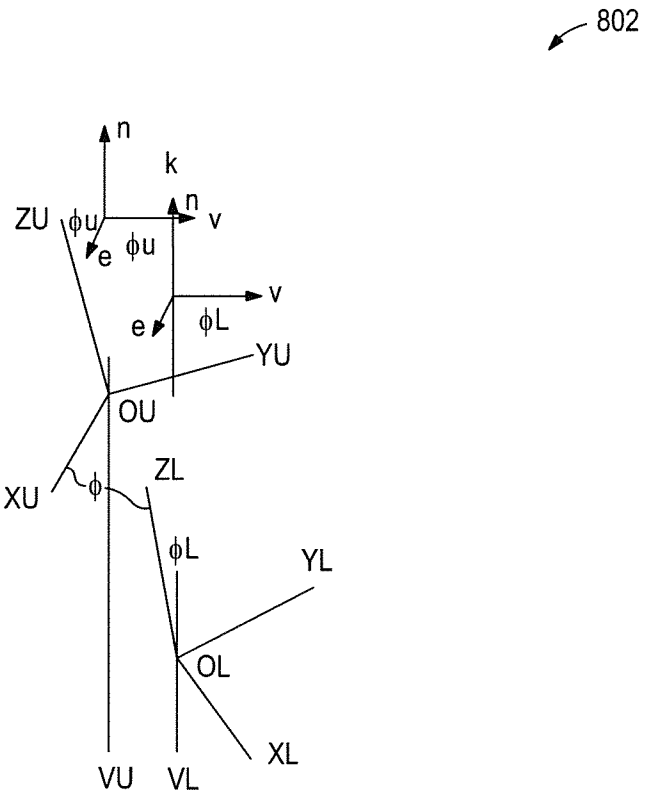
FIG. 12 illustrates mapping coordinates from a reference of the third survey instrument package to a reference of the second survey instrument package, according to one or more embodiments of the present disclosure.

In one or more embodiments, the calculated azimuth and inclination of the lower portion of the rotary steerable system can be utilized to determine the azimuth of the upper portion of the rotary steerable system. FIG. 12 illustrates mapping coordinates from a reference of the third survey instrument package to a reference of the second survey instrument package, according to one or more embodiments of the present disclosure. Diagram 802 includes elements XL, YL, ZL, and OL defining the coordinate system of the lower portion including the third survey instrument package. In the depicted example, ZL is the symmetry axis of the lower portion and OL is the origin. In the depicted example, XH, YH, ZH define the coordinate system in the upper portion of the rotary steerable system. ZH is the symmetry axis of the upper portion and OH is the origin. VU is a vertical line drawn through the OU. VL is a vertical line drawn through the OL.

In the depicted example, θU is the inclination of the upper portion and θL is the inclination of the lower portion. In the depicted example, ψ is the tool-face angle in the coordinates of the upper portion of the projection of AD, the axis of symmetry of the lower portion of the rotary steerable system.

As previously described, the lower assembly can be brought into alignment with the upper assembly by rotating it about the vertical through the angle ψ and then about the OL-XL axis through the angle θL-θU. In one or more embodiments, by applying these transformations to the magnetic field values of the third survey instrument package, it is possible to calculate the azimuth with the coordinate system of the second survey instrument package.

Various examples of aspects of the disclosure are described below as clauses for convenience. These are provided as examples, and do not limit the subject technology.

Clause 1. A method to steer a drill bit of a rotary steerable system within a wellbore, the method comprising: introducing the rotary steerable system into the wellbore, the rotary steerable system comprising: an upper portion coupled to a drill string; a lower portion coupled to the upper portion via a flexible collar, the lower portion having the drill bit coupled thereto; a first survey instrument package and a second survey instrument package disposed within the upper portion, wherein the second survey instrument package is axially offset from the first survey instrument package; and a third survey instrument package disposed within the lower portion, wherein the third survey instrument package is axially offset from the drill bit; establishing a magnetic model associated with the drill bit with an initial source position; measuring a respective plurality of magnetic field parameters at the first, second, and third survey instrument packages; determining an initial azimuth of the magnetic model based on the plurality of magnetic field parameters of the third survey instrument package; determining a magnetic gradient tensor from the magnetic field parameters of the first and second survey instrument packages; solving for a calculated tool-face angle, a calculated bend angle, and a calculated azimuth with respect to the magnetic model based on the magnetic gradient tensor, the initial azimuth and the initial source position; and steering the drill bit via the rotary steerable system based on the calculated tool-face angle, the calculated bend angle, and the calculated azimuth.

Clause 2. A method to steer a drill bit of a rotary steerable system within a wellbore, the method comprising: introducing the rotary steerable system into the wellbore, the rotary steerable system comprising: an upper portion coupled to a drill string; a lower portion coupled to the upper portion via a flexible collar, the lower portion having the drill bit coupled thereto; a first survey instrument package and a second survey instrument package disposed within the upper portion, wherein the second survey instrument package is axially offset from the first survey instrument package; and a third survey instrument package disposed within the lower portion, wherein the third survey instrument package is axially offset from the drill bit; establishing a magnetic model associated with the drill bit with an initial source position; measuring a respective plurality of magnetic field parameters at the first, second, and third survey instrument packages; solving an initial tool-face angle, an initial bend angle, and an initial azimuth based on the magnetic field parameters with respect to the magnetic model; identifying an initial source position of the magnetic model; determining a magnetic gradient tensor based on the magnetic field parameters of the first, second, and third survey instrument packages; solving for a calculated tool-face angle, a calculated bend angle, and a calculated azimuth with respect to the magnetic model based on the magnetic gradient tensor, the initial tool-face angle, the initial bend angle, and the initial azimuth; and steering the drill bit via the rotary steerable system based on the calculated tool-face angle, the calculated bend angle, and the calculated azimuth.

Clause 3. The method of any preceding Clause, further comprising corresponding the calculated tool-face angle and the calculated azimuth based on the magnetic model to the drill bit, and corresponding the calculated bend angle to the rotary steerable system.

Clause 4. The method of any preceding Clause, further comprising establishing the magnetic model as a line of magnetic charge.

Clause 5. The method of any preceding Clause, further comprising establishing the magnetic model as a generalized dipole field.

Clause 6. The method of any preceding Clause, further comprising measuring a respective gravitational field parameter at the first, second, and third survey instrument packages.

Clause 7. The method of Clause 6, further comprising calculating a gravitational tool-face value corresponding to the second survey instrument package.

Clause 8. The method of Clause 7, further comprising determining a tool-face offset for the second survey instrument package based on the gravitational tool-face value corresponding to the second survey instrument package.

Clause 9. The method of any preceding Clause, further comprising calculating a gravitational tool-face value corresponding to the first survey instrument package a parameter based on the second survey instrument package.

Clause 10. The method of Clause 9, further comprising determining a tool-face offset for the first survey instrument package based on the gravitational tool-face value corresponding to the first survey instrument package.

Clause 11. The method of any preceding Clause, further comprising measuring a plurality of respective gravitational field parameters at the first, second, and third survey instrument packages.

Clause 12. The method of Clause 11, further comprising determining expected values of Bxx, Byy, Bxy, Bxz, Byz, Byz based on the respective magnetic field parameters the plurality of respective gravitational field parameters of the first, second, and third survey instrument packages.

Clause 13. The method of any preceding Clause, further comprising synchronizing a time of measurement of the respective magnetic field parameter at the first, second, and third survey instrument packages.

Clause 14. The method of Clause 13, further comprising synchronizing a tool-face angle of the respective magnetic field parameter at the first, second, and third survey instrument packages.

Clause 15. The method of any preceding Clause, further comprising determining an x-axis cross-axial magnetic field component and a y-axis cross-axial magnetic field component based on the magnetic field parameter of the third survey instrument package.

Clause 16. The method of Clause 15, further comprising determining the x-axis cross-axial magnetic field component and the y-axis cross-axial magnetic field component via multiple station analysis.

Clause 17. The method of Clause 15, further comprising removing the x-axis cross-axial magnetic field component and the y-axis cross-axial magnetic field component based on the magnetic field parameter of the third survey instrument package.

Clause 18. The method of Clause 15, further comprising calculating a total magnetic field based on the magnetic field parameter of the third survey instrument package.

Clause 19. The method of Clause 18, further comprising calculating a calculated package-to-bit offset based on the total magnetic field of the third survey instrument package.

Clause 20. The method of Clause 19, further comprising determining a z-axis interference based on the calculated package-to-bit offset and the package-to-bit offset based on the drill bit.

Clause 21. The method of any preceding Clause, further comprising filtering the respective magnetic field parameters of the first, second, and third survey instrument packages.

Clause 22. The method of any preceding Clause, further comprising determining representative values of Bxx, Byy, Bxy based on the respective magnetic field parameters of the first, second, and third survey instrument packages.

Clause 23. The method of Clause 22, further comprising performing a linear regression to determine the representative values of Bxx, Byy, Bxy based on the respective magnetic field parameters of the first, second, and third survey instrument packages.

Clause 24. The method of any preceding Clause, further comprising averaging values of Bxz, Byz, Bzz based on the respective magnetic field parameters of the first, second, and third survey instrument packages.

Clause 25. The method of any preceding Clause, further comprising removing a source of magnetic interference associated with an electrical current.

Clause 26. The method of any preceding Clause, further comprising removing a source of magnetic interference associated with a downhole component.

Clause 27. The method of any preceding Clause, wherein solving for the calculated tool-face angle, the calculated bend angle, and the calculated azimuth comprises performing a binary search.

Clause 28. The method of Clause 27, further comprising providing at least one environmental parameter to the binary search.

Clause 29. The method of Clause 28, further comprising providing the calculated tool-face angle, the calculated bend angle, and the calculated azimuth to the binary search.

Clause 30. The method of any preceding Clause, wherein the first, second, and third survey instrument packages include an inclinometer and a magnetometer.

Clause 31. A drill string control system, comprising: a rotary steerable system including: an upper portion coupled to a drill string; a lower portion coupled to the upper portion via a flexible collar, the lower portion having a drill bit coupled thereto; a first survey instrument package and a second survey instrument package disposed within the upper portion, wherein the second survey instrument package is axially offset from the first survey instrument package; a third survey instrument package disposed within the lower portion, wherein the third survey instrument package is axially offset from the drill bit; and a controller including a processor and a non-transitory computer readable medium, the rotary steerable system communicatively coupled to the controller, wherein the computer readable medium stores a computer readable program code that, when executed by the processor, configures the processor to perform a method described in Clause 1-30.

Clause 32. A non-transitory medium readable by a processor and storing instructions for execution by the processor for performing a method described in Clause 1-30.

What is claimed is:

1. A method to steer a drill bit of a rotary steerable system within a wellbore, the method comprising:

introducing the rotary steerable system into the wellbore, the rotary steerable system comprising:

an upper portion coupled to a drill string;

a lower portion coupled to the upper portion via a flexible collar, the lower portion having the drill bit coupled thereto;

a first survey instrument package and a second survey instrument package disposed within the upper portion, wherein the second survey instrument package is axially offset from the first survey instrument package; and a third survey instrument package disposed within the lower portion, wherein the third survey instrument package is axially offset from the drill bit;

establishing a magnetic model associated with the drill bit with an initial source position;

measuring a respective plurality of magnetic field parameters at the first, second, and third survey instrument packages;

determining an initial azimuth of the magnetic model based on the plurality of magnetic field parameters of the third survey instrument package;

determining a magnetic gradient tensor from the magnetic field parameters of the first and second survey instrument packages;

solving for a calculated tool-face angle, a calculated bend angle, and a calculated azimuth with respect to the magnetic model based on the magnetic gradient tensor, the initial azimuth and the initial source position; and steering the drill bit via the rotary steerable system based on the calculated tool-face angle, the calculated bend angle, and the calculated azimuth.

2. The method of claim 1, further comprising corresponding the calculated tool-face angle and the calculated azimuth based on the magnetic model to the drill bit, and corresponding the calculated bend angle to the rotary steerable system.

3. The method of claim 1, further comprising measuring a respective gravitational field parameter at the first, second, and third survey instrument packages.

4. The method of claim 3, further comprising calculating a gravitational tool-face value corresponding to the second survey instrument package.

5. The method of claim 1, further comprising measuring a plurality of respective gravitational field parameters at the first, second, and third survey instrument packages.

6. The method of claim 5, further comprising calculating $B_{xx}$, $B_{yy}$, $B_{xy}$, $B_{xz}$, $B_{yz}$, $B_{zz}$ that are values for each gravitational tool-face angle from the respective magnetic field parameters the plurality of respective gravitational field parameters of the first, second, and third survey instrument packages.

7. The method of claim 1, further comprising synchronizing a time of measurement of the respective magnetic field parameter at the first, second, and third survey instrument packages.

8. The method of claim 1, further comprising determining an x-axis cross-axial magnetic field component and a y-axis cross-axial magnetic field component from the plurality of magnetic field parameters of the third survey instrument package.

9. The method of claim 8, further comprising determining the x-axis cross-axial magnetic field component and the y-axis cross-axial magnetic field component via multiple station analysis.

10. The method of claim 1, further comprising determining a representative gradient value in each of the $B_{xx}$, $B_{yy}$, $B_{xy}$ dimensions from the respective magnetic field parameters of the first and second survey instrument packages.

11. The method of claim 1, further comprising removing a source of magnetic interference associated with an electrical current.

12. The method of claim 1, further comprising removing a source of magnetic interference associated with a downhole component.

13. The method of claim 1, wherein solving for the calculated tool-face angle, the calculated bend angle, and the calculated azimuth comprises performing a non-linear least squares fit.

14. The method of claim 13, wherein solving for the calculated tool-face angle, the calculated bend angle, and the calculated azimuth comprises performing a binary search.

15. The method of claim 14, further comprising providing the calculated tool-face angle, the calculated bend angle, and the calculated azimuth to the binary search.

16. The method of claim 1, wherein the first, second, and third survey instrument packages include an inclinometer and a magnetometer.

17. A method to steer a drill bit of a rotary steerable system within a wellbore, the method comprising:

introducing the rotary steerable system into the wellbore, the rotary steerable system comprising:

an upper portion coupled to a drill string;

a lower portion coupled to the upper portion via a flexible collar, the lower portion having the drill bit coupled thereto;

a first survey instrument package and a second survey instrument package disposed within the upper portion, wherein the second survey instrument package is axially offset from the first survey instrument package; and a third survey instrument package disposed within the lower portion, wherein the third survey instrument package is axially offset from the drill bit;

establishing a magnetic model associated with the drill bit with an initial source position;

measuring a respective plurality of magnetic field parameters at the first, second, and third survey instrument packages;

solving an initial tool-face angle, an initial bend angle, and an initial azimuth based on the magnetic field parameters with respect to the magnetic model;

determining a magnetic gradient tensor based on the magnetic field parameters of the first, and second survey instrument packages;

solving for a calculated tool-face angle, a calculated bend angle, and a calculated azimuth with respect to the magnetic model based on the magnetic gradient tensor, the initial tool-face angle, the initial bend angle, and the initial azimuth; and steering the drill bit via the rotary steerable system based on the calculated tool-face angle, the calculated bend angle, and the calculated azimuth.

18. The method of claim 17, further comprising corresponding the calculated tool-face angle and the calculated azimuth based on the magnetic model to the drill bit, and corresponding the calculated bend angle to the rotary steerable system.

19. The method of claim 17, further comprising measuring a respective gravitational field parameter at the first, second, and third survey instrument packages.

20. A drill string control system, comprising:

an upper portion coupled to a drill string;

a lower portion coupled to the upper portion via a flexible collar, the lower portion having a drill bit coupled thereto;

a first survey instrument package and a second survey instrument package disposed within the upper portion, wherein the second survey instrument package is axially offset from the first survey instrument package;

a third survey instrument package disposed within the lower portion, wherein the third survey instrument package is axially offset from the drill bit; and a controller including a processor and a non-transitory computer readable medium, the drill string control system communicatively coupled to the controller, wherein the computer readable medium stores a computer readable program code that, when executed by the processor, configures the processor to perform a method comprising:

establishing a magnetic model associated with the drill bit with an initial source position;

measuring a respective plurality of magnetic field parameters at the first, second, and third survey instrument packages;

determining an initial azimuth of the magnetic model based on the plurality of magnetic field parameters of the third survey instrument package;

determining a magnetic gradient tensor based on the magnetic field parameters of the first, and second survey instrument packages;

solving for a calculated tool-face angle, a calculated bend angle, and a calculated azimuth with respect to the magnetic model based on the magnetic gradient tensor, the initial azimuth and the initial source position; and directing a rotary steerable system based on the calculated tool-face angle, the calculated bend angle, and the calculated azimuth.

* * * * *